United States Patent [19]

Vaiana et al.

[11] Patent Number: 4,797,960

[45] **Date of Patent: * Jan. 17, 1989**

[54] PATIENT TRANSFER ARRANGEMENT

[75] Inventors: Joseph G. Vaiana, Levittown; Paul DiMatteo, Dix Hills; Charles F. Chubb, Brookville, all of N.Y.

[73] Assignee: Nova Technologies Inc., Hauppauge, N.Y.

[ * ] Notice: The portion of the term of this patent subsequent to Jul. 14, 2004 has been disclaimed.

[21] Appl. No.: 13,687

[22] Filed: Feb. 12, 1987

Related U.S. Application Data

[63] Continuation-in-part of Ser. No. 731,533, May 7, 1985.

[51] Int. Cl.[4] ..... A61G 7/08

[52] U.S. Cl. ..... 5/81 R; 5/81 B; 297/337; 297/353; 297/75; 297/78

[58] Field of Search ..... 5/66, 67, 81 R–81 C, 5/8 G, 83, 90; 297/75, 78, 337, 353

[56] References Cited

U.S. PATENT DOCUMENTS

| | | | |
|---|---|---|---|
| 805,805 | 11/1905 | Loose | 5/81 R |
| 1,635,575 | 7/1927 | Cole | 5/81 B |
| 4,679,259 | 7/1987 | DiMatteo et al. | 5/81 C |

FOREIGN PATENT DOCUMENTS

| | | | |
|---|---|---|---|
| 172296 | 2/1986 | European Pat. Off. | 5/81 R |

*Primary Examiner*—Alexander Grosz
*Assistant Examiner*—Michael F. Trettel
*Attorney, Agent, or Firm*—Max Fogiel

[57] ABSTRACT

An arrangement of a wheelchair with a movable seat and leg rest and a bed equipped with transfer apparatus provided with rollers, a movable sheet and lift arms, for transporting a patient comfortably across the bed to a sitting position in the wheelchair.

20 Claims, 22 Drawing Sheets

PATIENT TRANSFER ARRANGEMENT

BACKGROUND OF THE INVENTION

The present application is a continuation-in-part of the parent application Ser. No. 731,533 filed May 7, 1985.

The process of transferring a patient between a bed and a wheelchair or commode often requires the help of two or more assistants. The task frequently requires considerable strength and is a common source of injury to the person being transferred or to the nurse(s) or attendant(s) doing the transfer. These problems often are the major factors that require a patient to be hospitalized or moved to a nursing home, rather than being cared for at home. They also increase the cost of caring for persons in hospitals and nursing homes.

SUMMARY OF THE INVENTION

The parent application describes an arrangement for transferring an invalid person from a bed to a separate horizontal surface by means of a sheet which is pulled over the surface of the mattress, by being rolled up on a roller at the foot of the bed and unrolled from a roller at the head of the bed. Accordingly, it is the primary object of the present invention to provide a special wheelchair, which may be a commode or may be convertible to a commode, and a bed equipped with rollers, a transport sheet, and a lifting mechanism, so that a person can be comfortably transported over the bed and partially onto the horizontal seat of the wheelchair and then raised to a normal sitting position thereon. The arrangement is such that no effort on the part of the invalid person and only minimal physical strength or skill in the part of an attendant are required.

In many cases invalid persons can easily be injured when they are being transferred between a bed and a wheelchair, as a result from stresses placed on weak bones or decubitus ulcers, or as a result of accidental falling. Accordingly, it is another object of the present invention to provide a comfortable and safe method of transfer with minimum stress on the person's body and minimum sliding action which could cause or aggravate decubitus ulcers.

It is still another object of the present invention to provide apparatus which can be installed on existing hospital or home-type beds so that a person can be comfortably transported to a seated position on a wheelchair or a commode, or a toilet at the end of the bed.

Additional objects and advantages of the present invention will become evident from the following description of specific embodiments when read in connection with the accompanying drawings.

It is to be understood that the term wheelchair, as used herein, includes commodes. The present invention is also applicable to transfer onto fixed chairs and seating, such as toilets, and there is no intent to limit the present invention to transfer between a bed and a wheelchair.

DESCRIPTION OF THE PREFERRED EMBODIMENTS

FIGS. 1*a* through 1*f* schematically illustrate the method used to transport a person from a wheelchair to a bed.

Figure 1A:
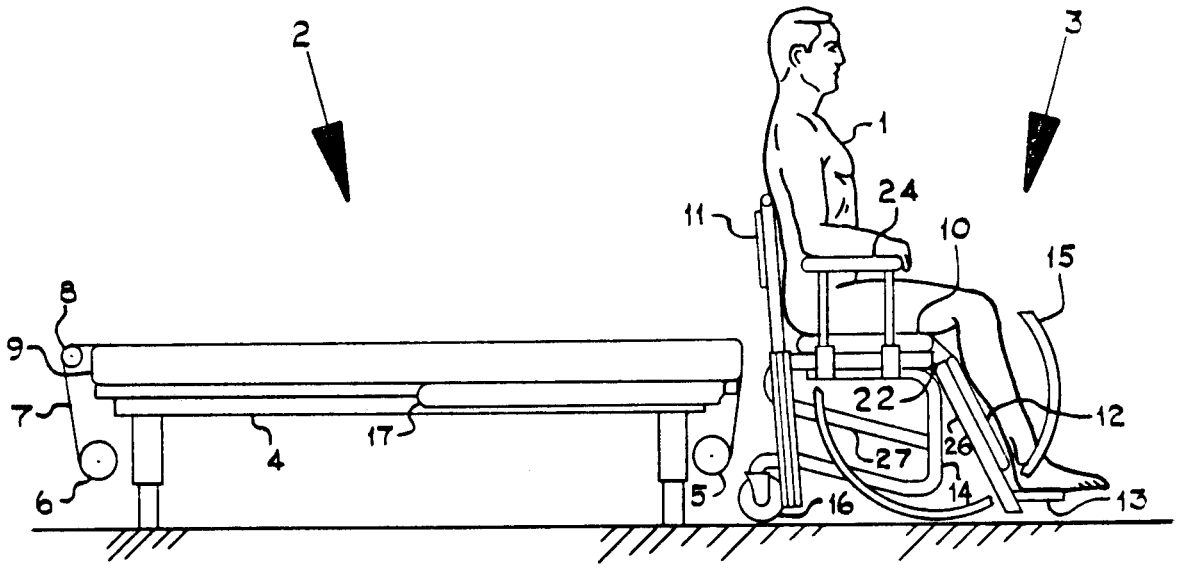
FIGS. 1*a* through 1*f* are schematic sequential views showing the transfer of a person between a wheelchair and a bed.

FIG. 1*a* shows the person 1 seated in a wheelchair 3 ready to be transferred to a bed 2. The bed 2 consists of a conventional bed 4, as found in a home or institution such as a nursing home or hospital, with modifications to be described. The bed is presumed to be adjustable by conventional means (not shown) to the proper height to perform the required operations.

Attached to the bed 4 is an arrangement for transporting a person longitudinally across the bed. This arrangement contains a front roller 5 (shown in FIG. 1*a*) whose length is approximately equal to the width of the bed. The roller is mounted at the foot-end of the bed. A similar rear roller 6 is positioned at the head-end of the bed. (Head and foot are seen from the patient's point of view.) A transport sheet 7, approximately equal in width to the width of the bed and significantly longer than the bed, is fastened to and partially rolled up on the front roller 5 while the other end is fastened to and partially rolled up on the rear roller 6 at the head-end of the bed. Transport sheet 7 passes over a supporting idler roller 8 between the mattress 9 and rear roller 6.

Electric motors, or hand cranks provide mechanical power for driving the two rollers 5 and 6 to wind up the transport sheet 7 on one roller while allowing it to unwind from the other roller so as to move the sheet, and to thereby transport a person reclining thereon, across the surface of the mattress.

This particular arrangement of roller is shown to help illustrate the principles applying to the present invention, but the invention is not limited to this configuration. Other arrangements for moving a sheet across a bed to transport a person over the bed can be used equally well.

Also attached to the bed 4, by means not shown, are a pair of mattress lift arms 17, which are described later.

The wheelchair 3 contains a frame 14 supported on front wheels 15, which are depicted as being large, and rear wheels 16, which are small and on casters. Alternatively, the front wheels may also be small, in which case either or both pairs may be on casters. The wheelchair back rest 11, is movably mounted as described subsequently.

The seat 10 and leg rest 12 of the wheelchair are mounted on a conveyor, to be shown, which is a single flexible assembly slidably mounted on tracks 26 and 27 on each side of the chair. The conveyor is stiff laterally to support a sitting person, but is bendable longitudinally to conform to the bends in tracks 26 and 27. Track 26 is hinged at the point 22 to enable the leg rest 12 to be raised. The foot rest 13 is attached to the conveyor below the leg rest 12.

Figure 1B:
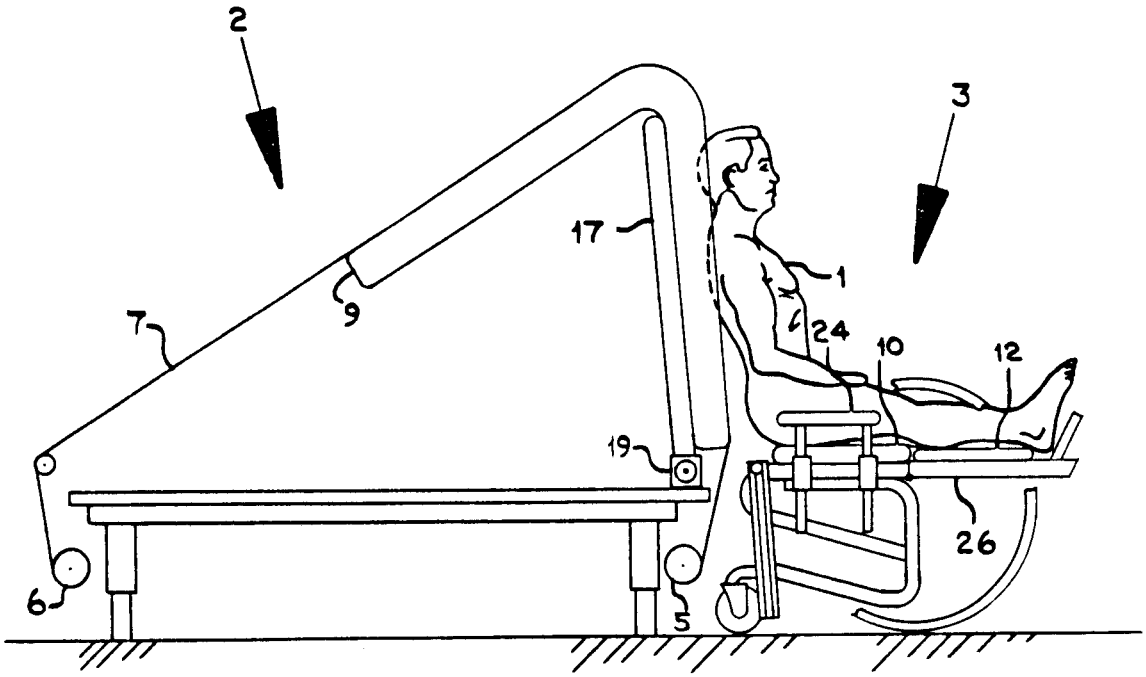

FIG. 1*b* shows the initial transfer steps. The wheelchair 3 has been latched, by means not shown, to the end of the bed 2. The lift arms 17, which include a connecting support under the mattress 9, have been rotated by a lift drive 19, comprising an electric motor, gearing and a support pivot to lift the mattress up to approximately 80 degrees, as shown, with the sheet 7 unrolled as needed from head-end roller 6. The leg rest 12 has been raised by the attendant, or by power means not shown, from its normal seating position, inclined down from the seat 10 to a substantially horizontal position. The lifting action is aided by a spring, not shown. Mechanical couplings, shown subsequently, from the hinged track 26 have caused the back rest 11, shown in FIG. 1*a*, and arm rests 24 to be lowered out of the way of the transport path when the leg rest 12 was raised. The person 1 is resting against and supported by the mattress 9.

Figure 1C:
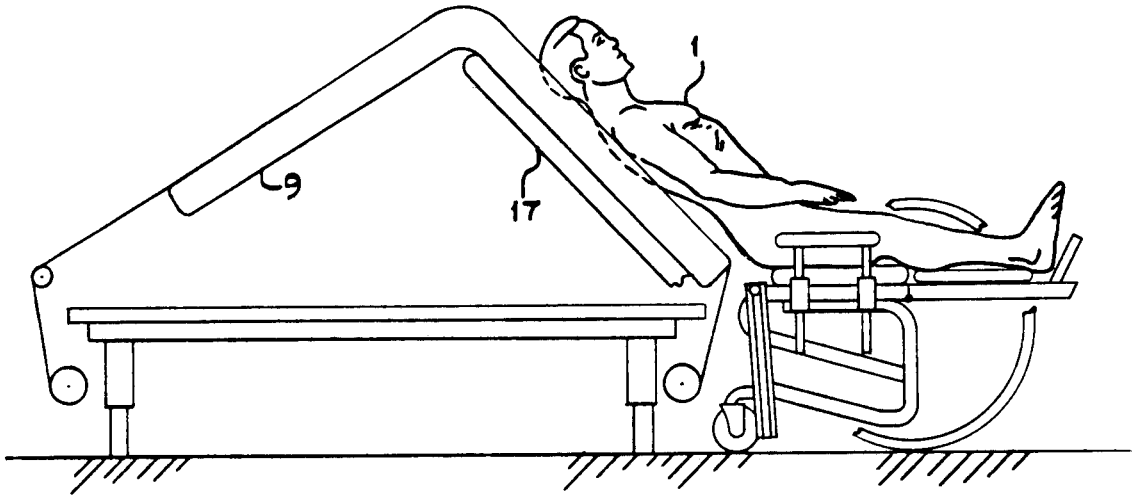

FIG. 1*c* shows the first step of the actual transfer of the patient by the action of lowering the mattress lift arms 17 which have lowered the person 1 to a partially reclining position, supported by the mattress 9.

Figure 1D:
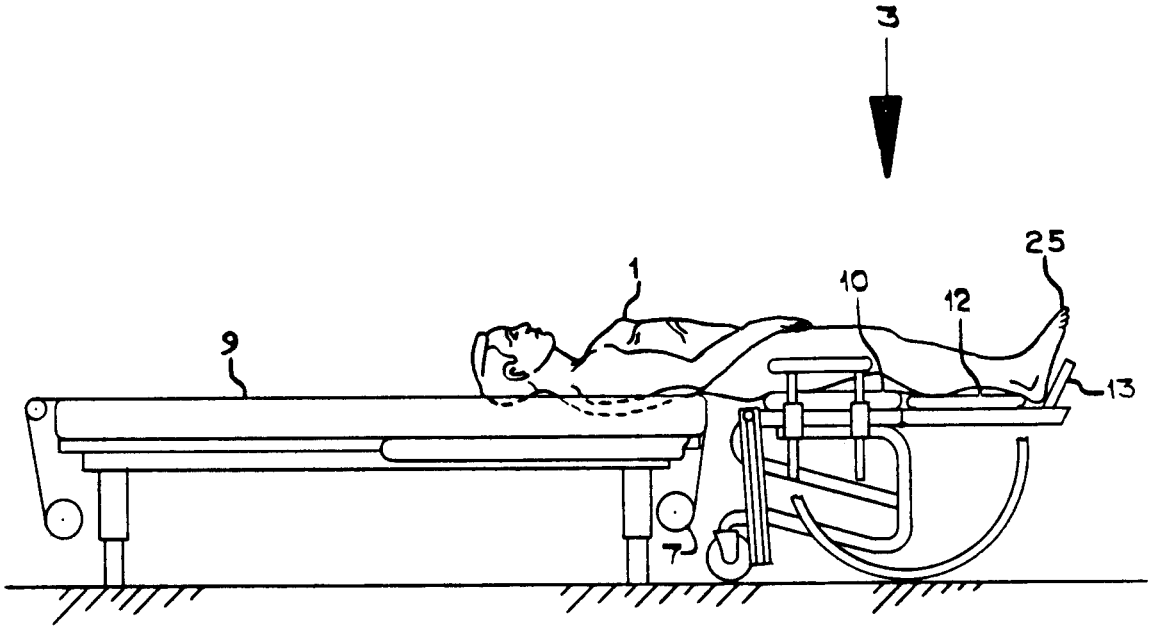

FIG. 1*d* shows the person or patient 1 reclining partly on the fully lowered mattress 9 with his feet 25 resting against the foot rest 13.

Figure 1E:
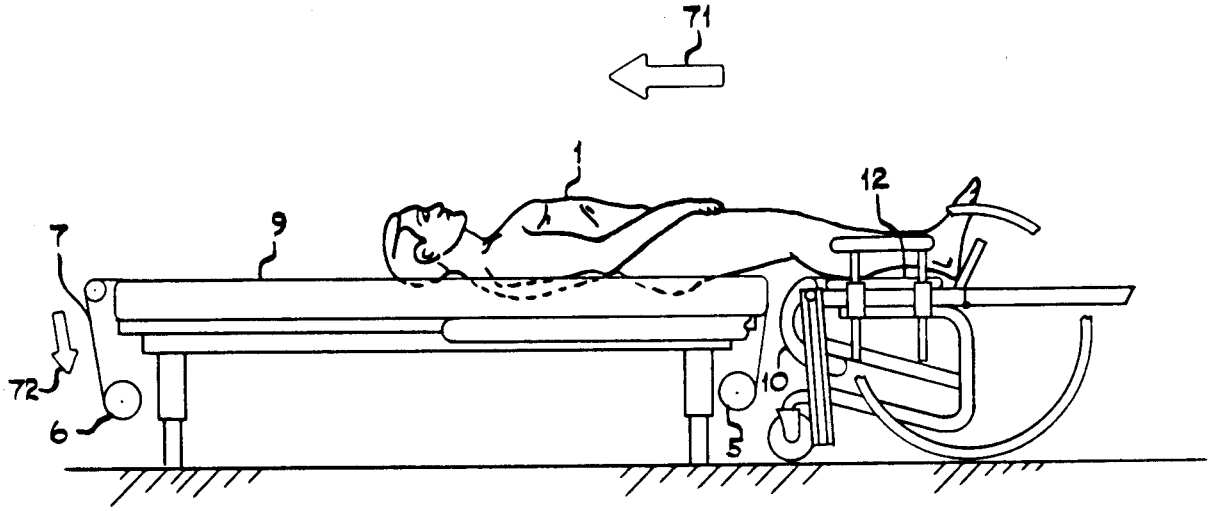

FIG. 1*e* shows, by arrows 71 and 72, the action of the sheet in pulling the person 1 onto the mattress 9 as the rear roller 6 is driven to wind up the sheet 7, drawing it across the mattress from the front roller 5. As the person is drawn onto the mattress, the conveyor slides freely with him, along its tracks from its forward position to its rear position, so that the person's body is protected from discomfort due to sliding over the seat.

Figure 1F:
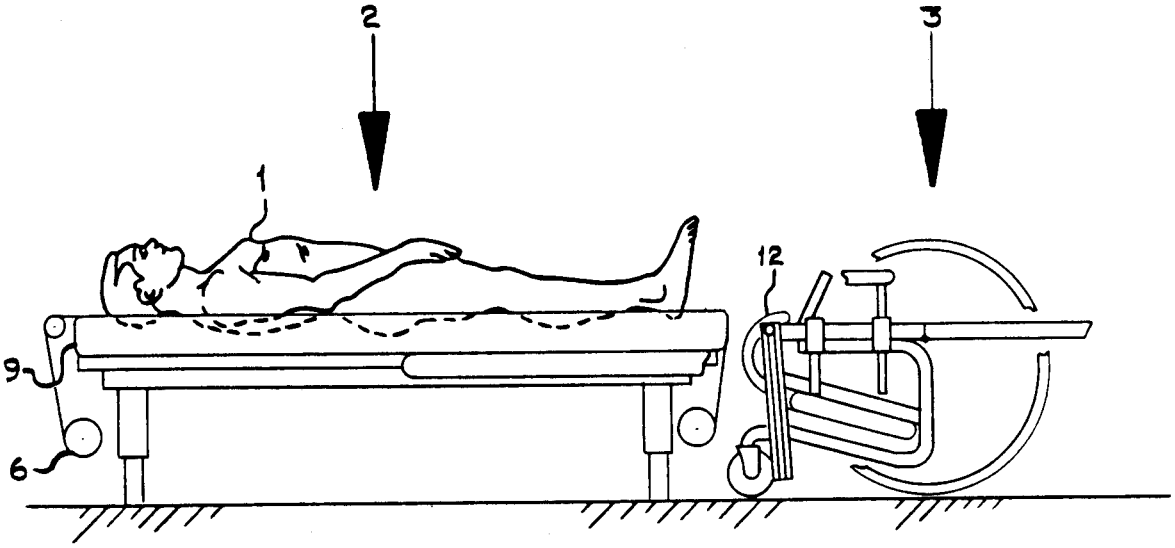

As shown in FIG. 1*f*, the roller 6 continues to move the person 1 until he reaches the middle of the mattress 9. His feet slide off the leg rest 12, which is soft and covered with a smooth slippery material such as nylon to prevent skin irritation. The wheelchair 3 can then be unlatched and removed from the bed 2, if desired.

To transfer back onto the wheelchair, the process is reversed.

FIG. 1*e* shows the patient 1 after he has been transported by the motion of sheet 7 as the sheet is wound up on the roller 5 and unwound from the roller 6, part way onto the wheelchair oppositely from arrows 71 and 72.

FIG. 1*d* shows that pressure from the person's feet 25 on the foot rest 13 causes the seat 10 and leg rest 12, to slide forward as the transport sheet 7 carries the person further onto the wheelchair 3. When the person 1 is comfortably positioned on the seat 10 with the leg rest in its forward limit position, as shown in FIG. 1*d*, the sheet drive is stopped.

FIG. 1*c* shows the mattress 9 partially elevated by lift arms 17. FIG. 1*b* shows the mattress 9 fully raised and supporting the person 1 on the seat 10. At this point the attendant pushes down the leg rest 12, thereby raising the back rest 11 and arm rest 24, to the positions shown in FIG. 1*a*.

At this point, the wheelchair can be unlatched and moved away from the bed, and the mattress lift arms 17 lowered to complete the transfer operation.

Figure 2:
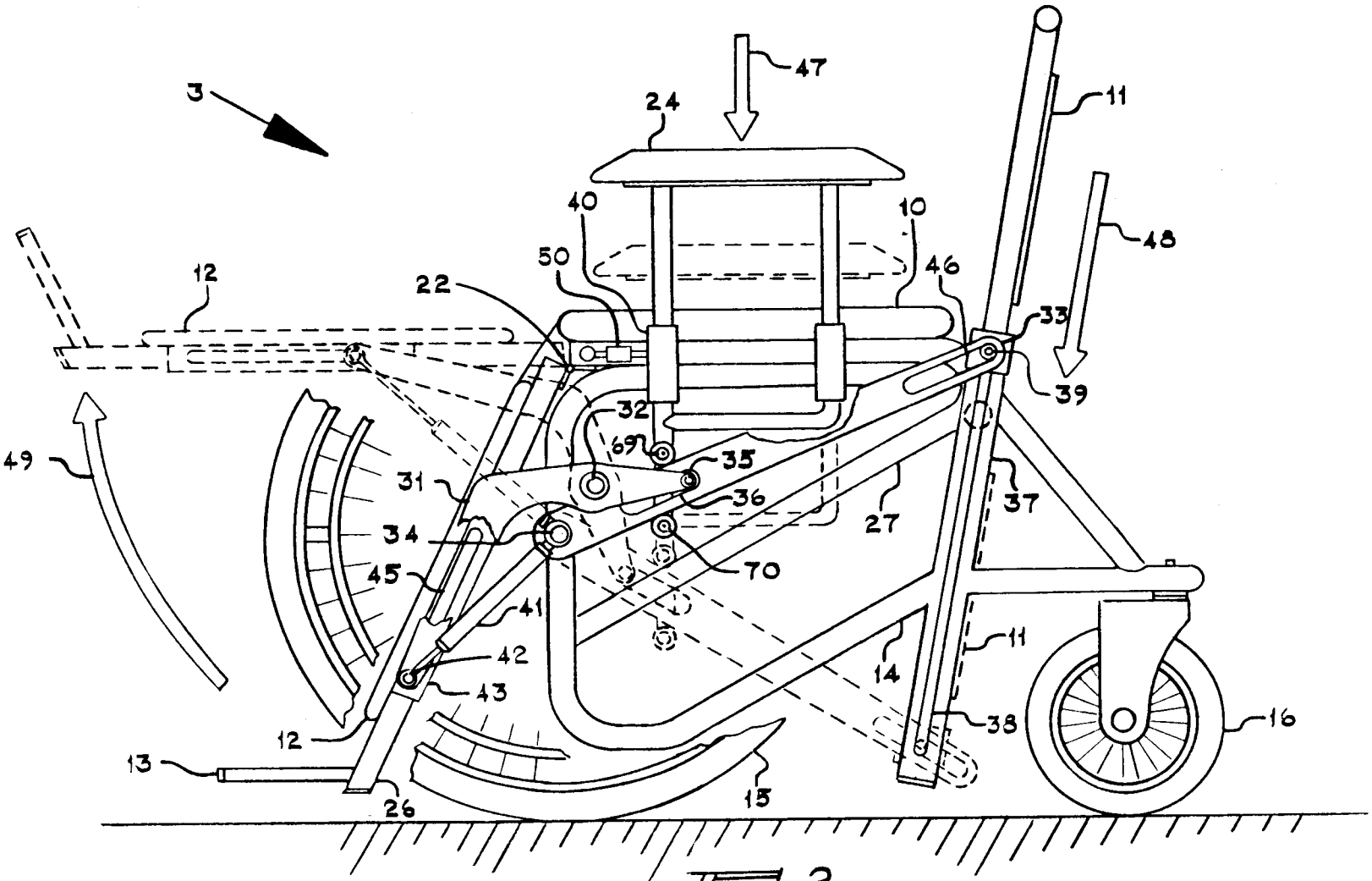
FIG. 2 is a side view of the wheelchair in its normal seating arrangement with the leg rest lowered.

FIG. 2 is a side view showing the wheelchair 3 in its normal seating arrangement with the leg rest 12 lowered, corresponding to schematic view FIG. 1*a*. Large front wheels 15 and small rear wheels and casters 16, enable the wheelchair to move close to the transfer bed for patient transfer. The seat 10, the leg rest 12, and the foot rest 13 are attached to a conveyor (shown in a subsequent drawing) which slides in and is supported by tracks 26 and 27. The track 26 is attached to the fixed track 27 and the frame 14 through a hinge 22, and is connected through linkages, described below, to the arm rest 24 and back rest 11 such that depressing the arm rest 24 raises the leg rest 12 to its horizontal position 12 and moves the back rest 11 to its lowered position (both shown in dashed lines).

A link 31, pivoted to the frame 14 at a pivot 32, is connected by the pivot 42 to a compression spring 41, which is attached to a pivot 34 in the frame 14. Pushed by the spring 41, the pivot 42 slides in the slot 45 in a member 43 attached to the track 26 and pushes the track 26 up toward its horizontal position. The force of the spring 41 is selected to overcome most of the gravity force acting to push the leg rest down when a person is seated in the wheelchair. At the opposite end of the link 31 is a pin 35 which slides in a slot 36 in a coupling link 33. The latter is pivoted at one end on the pivot 34 and at the other end it has a slot 46 which is coupled to and supports the back rest 11 through the pin 39. The back rest 11 slides in slot 38 in support 37 in accordance with motion of coupling link 33. The link 33 is enclosed by rollers 69 and 70 on the arm rest 24 which is mounted in vertical slides 40, attached to the frame 14. Latch 50 locks the arm rest 24 in either its upper or lower positions, and thereby also locks coupling link 33 and prevents movement of the leg rest and back rest. An attendant can release the latch 50 and press down on the arm rest 24 in the direction of arrow 47 to push down the link 33 through the roller 69, thereby lowering the back rest 11 in the direction of the arrow 48 and, through the link 31, raising the leg rest 12 in the direction of arrow 49 to a horizontal position. At that point the arm rest 24 reaches its lowest position, where the latch 50 automatically locks it in place. Alternatively, instead of depressing the arm rest, the attendant can depress the back rest or lift the leg rest 12 to obtain the same result, by means of the linkages described above. The resulting positions of the arm rest 24, leg rest 12, back rest 11, spring 41, and links 31 and 33 are shown in dashed lines.

Figure 2A:
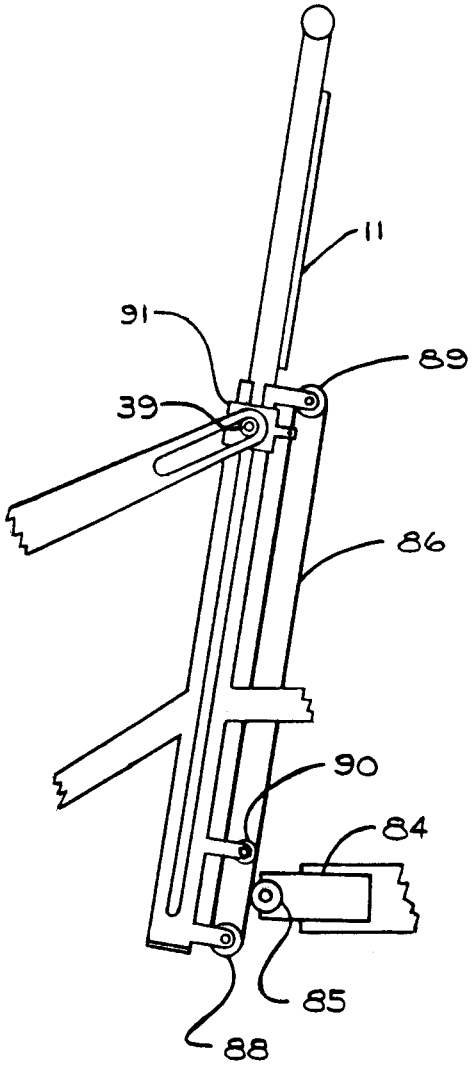
FIG. 2*a* is a partial side view of the wheelchair, showing a powered arrangement for raising and lowering the backrest.

FIG. 2*a* is a partial side view showing a powered arrangement for moving the back rest 11, the arm rest 24, and the leg rest 12 through the linkage described above. With the wheelchair 3 latched to the bed 2, not shown here, a toothed belt 86 on the wheelchair is meshed with a gear 85 on a reversible electric motor 84 mounted on the bed. Energizing the motor 84 drives the belt 86 around idler rollers 88, 89, and 90. The belt 86, which is attached through the sliding member 91 to the pin 39 on the back rest 11, thereby elevates or lowers the sliding back 11, which is attached to the belt 86 through the pin 39 and the sliding member 91.

Figure 3:
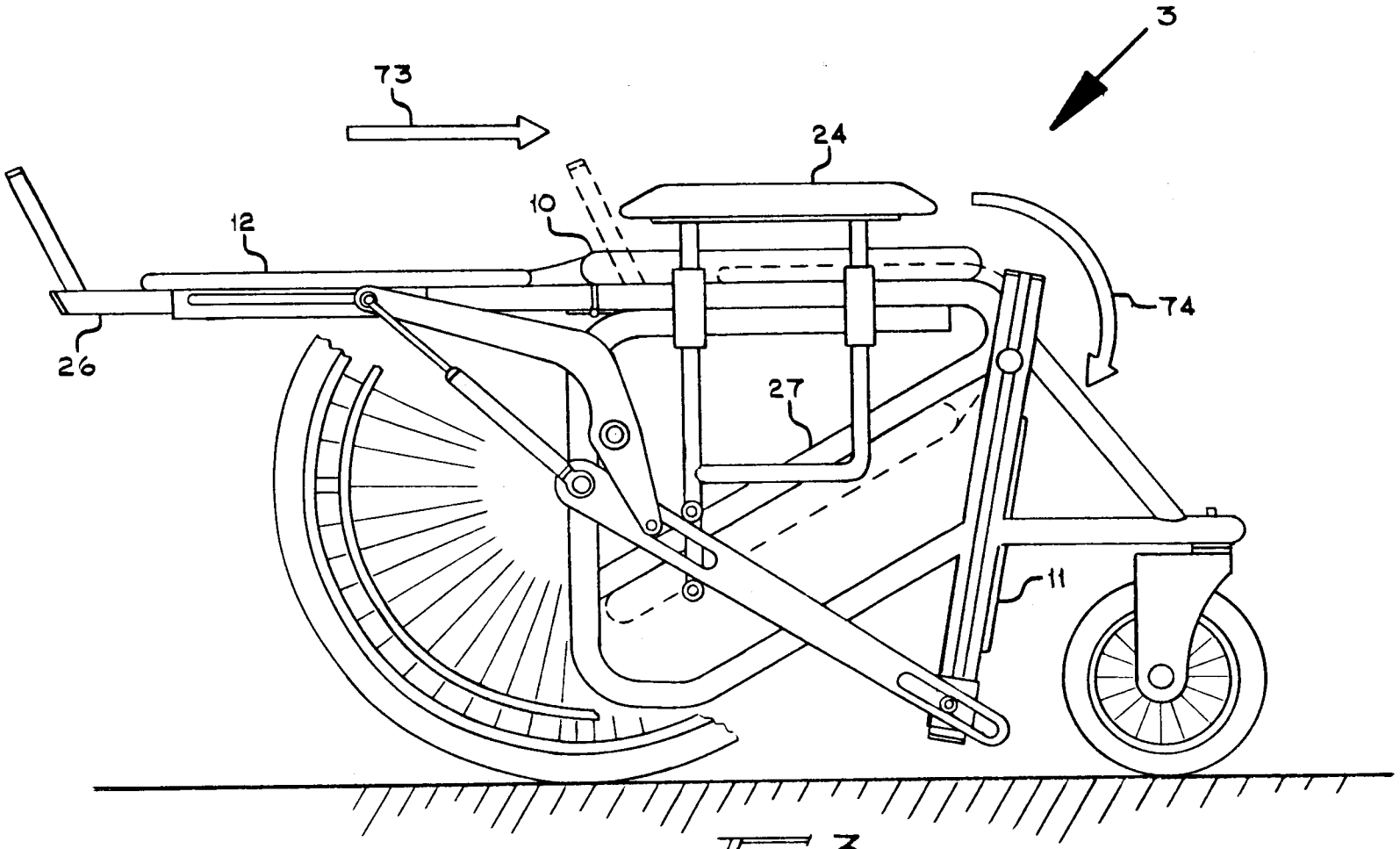
FIG. 3 is a side view of the wheelchair with the leg rest raised.

FIG. 3 is a side view of the wheelchair 3 showing (in solid lines) the wheelchair with the leg rest 12 in its elevated position and the back rest 11 and arm rests 24 lowered, corresponding to schematic view FIG. 1*d*.

With the wheelchair in this position a person would be reclining with his legs on the wheelchair and his back and head resting on the transfer sheet of the bed. As the transfer sheet draws the person off the wheelchair, the leg rest 12 and seat 10, mounted on the conveyor, slide freely in track members 26 and 27 in the direction of arrows 73 and 74.

The seat 10 and leg rest 12 bend flexibly as they follow track 27 to their limit positions, shown in dashed lines, corresponding to schematic view FIG. 1*f*.

Figure 4:
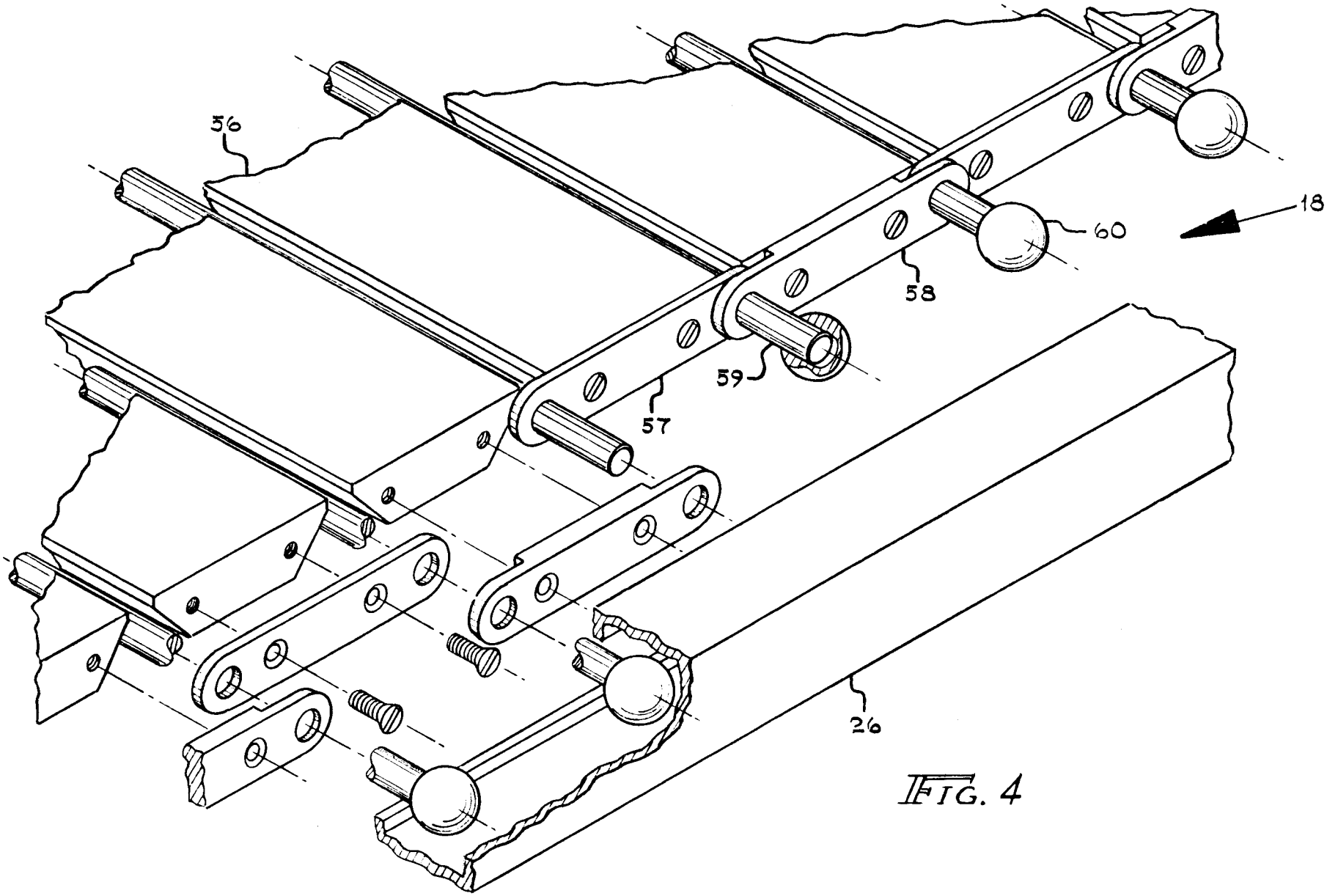
FIG. 4 is an exploded partial view of a section of the conveyor.

FIG. 4 is a partial exploded view showing the construction of the conveyor 18 and the track 26 (or the straight portion of the track 27, which is identical). Over most of its length, the conveyor 18 contains slats 56 which extend across the wheelchair. Links 57 and 58 are screwed or otherwise fastened to the ends of the slats 56 in an alternating pattern, as shown, and adjacent links are hinged together by shafts 59 which pass through holes in the links and which extend across the wheelchair. The shafts 59 are supported by rollers 60, which are preferably spherical but, alternatively, they may be cylindrical in shape. The shafts 59 and slats 56 are stiff and thereby can support the weight of a person between the track members 26 on each side of the wheelchair 3.

Figure 5:
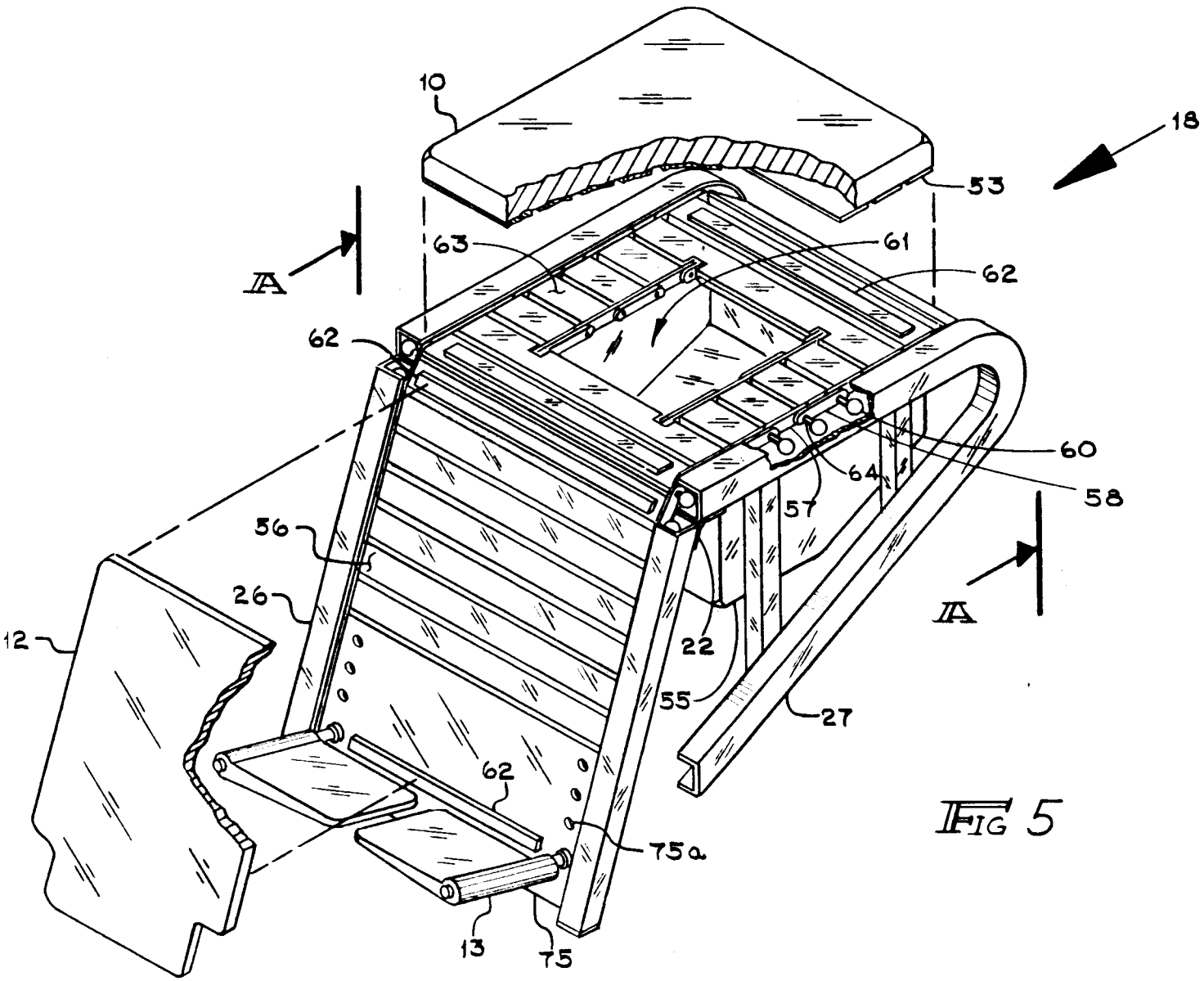
FIG. 5 is a partial perspective view of the seat and leg rest section of the wheelchair.

FIG. 5 is a partial perspective view showing the arrangement of the conveyor 18. The conveyor 18 includes an end plate 75 with several selectable holes 75*a* for attaching the foot rests 13 by nuts on threaded shafts, or the like. The remaining upper surface of the conveyor 18 consists of long slats 56 and short slats 63, hingeably connected one to another through links 57 and 58 by long shafts 59 (not visible in FIG. 5) and short shafts 64. The shafts are attached at their outer ends to rollers 60, which freely roll in and are supported by tracks 27 and 26. Short slats 63 and short shafts 64 are used in the seat section of conveyor 18 and form an opening 61 above the chamber pot 55. The seat 10, which is a cushion, and the leg rest 12, which is a pad, are attachable to the conveyor 18 by strips of touch-and-close, pull-and-release material 62, available under the trade name VELCRO, or by other means such as snaps, hooks, or the like. The seat 10 contains stiffeners 53 to support a person over the opening 61.

Figure 5C:
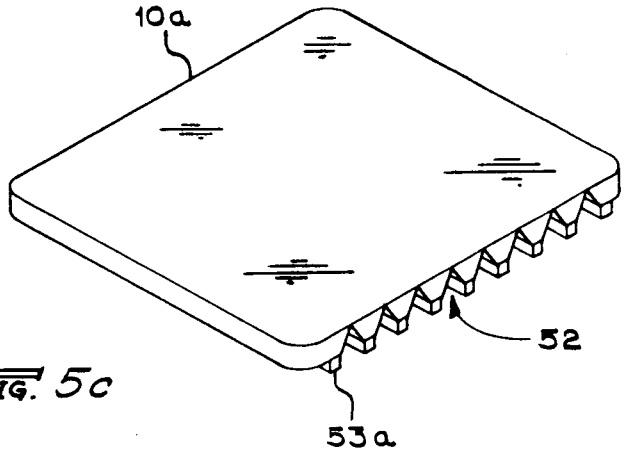
Figure 5B:
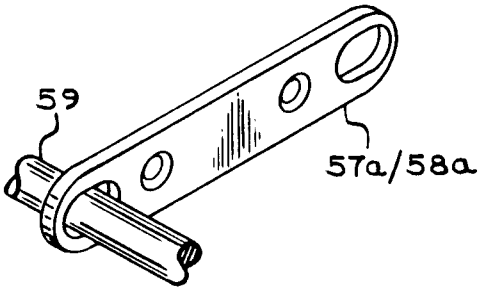
Figure 5A:
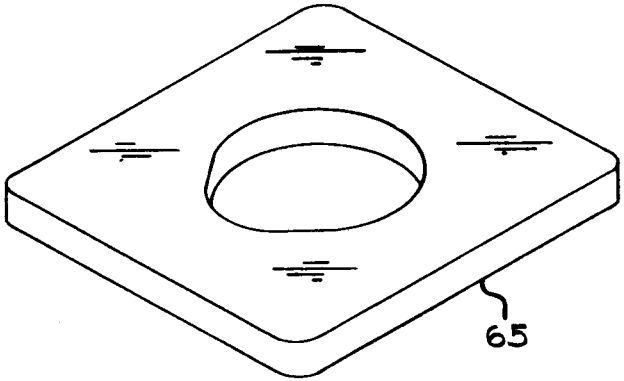

FIG. 5*a* shows a toilet seat 65, which is similarly attachable to the conveyor 18 in place of the seat cushion 51.

The seat 10, leg rest pad 12, and toilet seat 65 are constructed of flexible material such as foam rubber, and they have a stretchable cloth surface to enable free movement around the bent portion of the track 27.

FIGS. 5*b* and 5*c* show an alternate arrangement which allows the conveyor 18 and the bottom of the seat 10 to compress and bend in traversing track 27. FIG. 5*b* shows link 57*a* and 58*a* with elongated holes around shafts 59, which allow adjacent slats 56 in the conveyor 18, as shown in FIG. 4, to slide a distance together and apart. FIG. 5*c* is a partial side view of the seat 10*a* showing slots 52 and narrow stiffening slats 53*a* which allow the bottom of the seat 10*a* to compress for bending. The conveyor 18 shown in FIG. 5, if fitted with links 57*a* and 58*a* and the seat 10*a*, is thereby freely movable around the bend in track 27.

Figure 6:
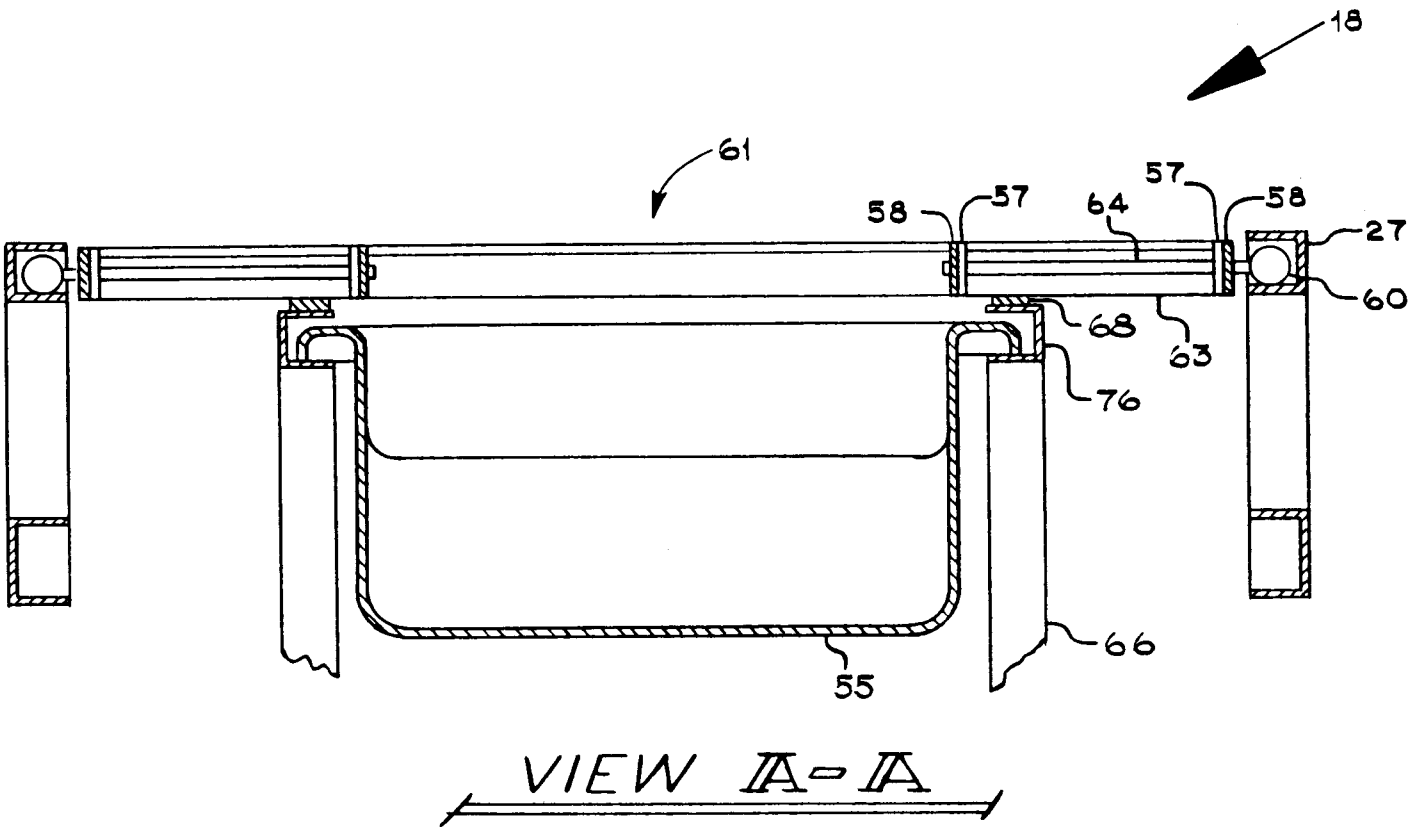
FIG. 6 is a front cross-sectional partial view of the seat region of the wheelchair showing the support structure for the conveyor and chamber pot.

FIG. 6, which is a sectional front view A—A in FIG. 4, shows the mounting and support arrangement of the seating area of the wheelchair. The roller 60 supported by the track 27 is attached to the short shaft 64 which passes through and connects two overlapping links 57 and 58, near each end of a short slat 63. The outside end of slat 63 is thereby supported by the track 27. The inside end of short slat 63 slides over and is supported on a slide 68 which is mounted on the channel 76, attached through the bracket 66 to the wheelchair frame (not shown here). The slide 68 can be comprised of a slippery material such as PTFE, commonly available under the trade name TEFLON, or high density polyurethane to facilitate free sliding (or other suitable sliding means). The chamber pot 55 is removably mounted on the channel 76.

Figure 7:
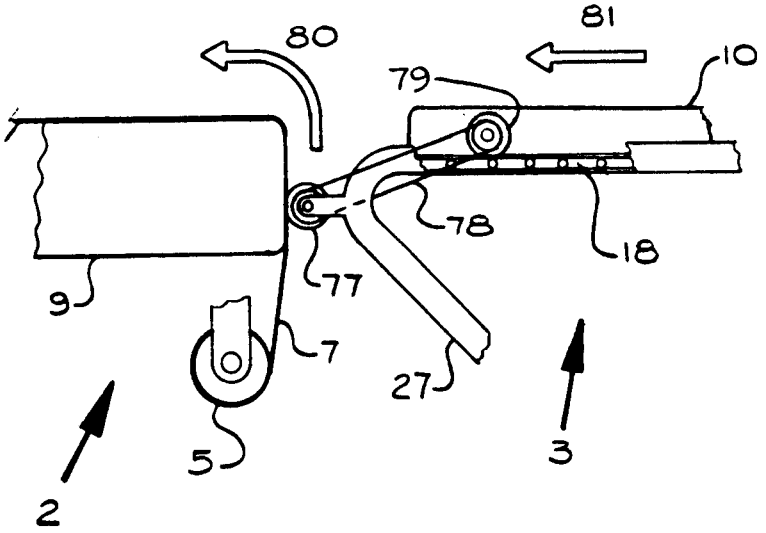
FIG. 7 is a partial side view of the bed and wheelchair showing a method of driving the conveyor and seat from the transport sheet of the bed.

FIG. 7 is a partial side view of the bed 2 and wheelchair 3 showing a method of driving the conveyor from a transport sheet. A friction roller 77, mounted through bearings on the track 27 of the wheelchair, is positioned in contact with the transport sheet 7 when the wheelchair is locked in place for patient transfer. A chain 78 meshes with integral sprockets on the friction roller 77 and on the friction roller 79, which is mounted through bearings on the wheelchair frame. The friction roller 79 rests firmly on the conveyor 18 on which is mounted seat 10. When a person is reclining partly on the seat 10 and partly on mattress 9, the transport sheet 7 is drawn off the roller 5 in the direction of the arrow 80 to transport the person onto bed 2. The friction rollers 77 and 79 have high friction surfaces of rubber, or the like, and thereby are driven by the transport sheet 7 and drive the conveyor 18 in the direction of the arrow 81.

Figure 7A:
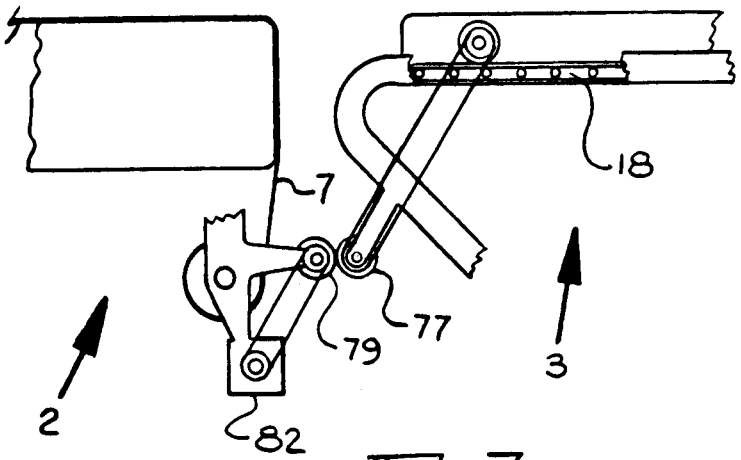
FIG. 7*a* is similar to FIG. 7, except showing a motor coupled to the conveyor.

FIG. 7*a* shows an alternate method of driving the roller 77, and thereby the conveyor 18, using a reversible electric motor 82 in place of the sheet 7. The roller 79, mounted on the bed 2 and coupled to the electric motor 82, is held in good frictional driving contact with the roller 77 when the wheelchair 3 is latched to the bed 2.

Figure 8:
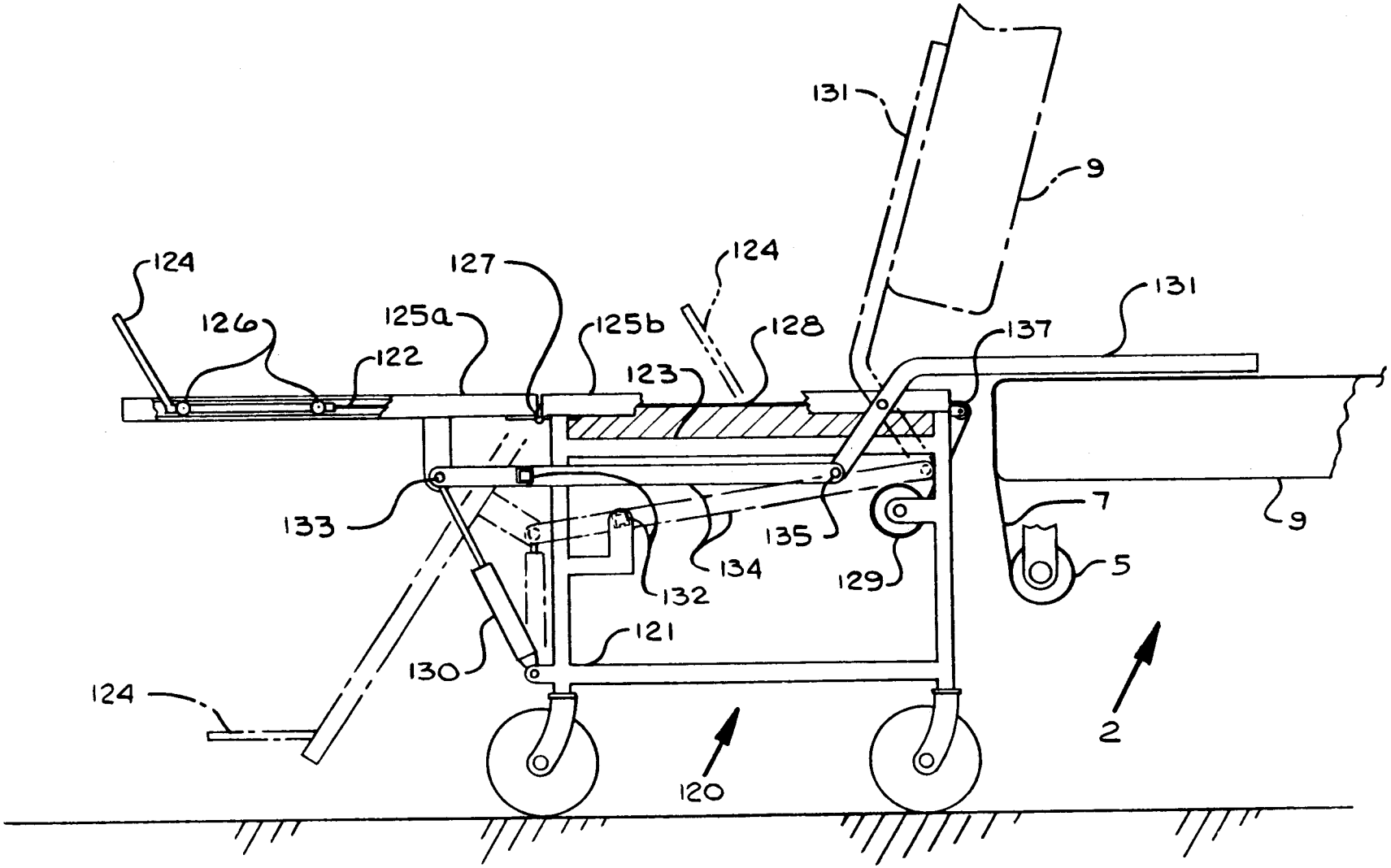
FIG. 8 is a partial side view of the bed and an alternate wheelchair arrangement with a cloth strip conveyor over the leg rest and seat.

FIG. 8 is a partial side view of the wheelchair and bed showing an alternate conveyor arrangement. The wheelchair 120 is positioned at the foot of the bed 2, adjacent to the mattress 9 over which the transport sheet 7 passes and is partially wound on the roller 5. The wheelchair 120 includes a frame 121, a seat 125 removably attached thereon, and a leg rest 122, which comprises the front portion of a conveyor cloth 128. The leg rest is shown in its elevated position ready for transporting a reclining person off the wheelchair and onto the bed, as shown in FIG. 1*d*. A foot rest 124 includes a support plate with rollers 126 on each side, which are supported by, and roll in, forward tracks 125*a* and rear tracks 125*b* comprising U-channels extending along each side of the wheelchair. The track 125*a* is mounted by a hinge 127 to the track 125*b*, which is mounted on the frame 121. The conveyor cloth 128 is a strip of cloth attached through leg rest 122 to the foot rest 124, and extending over the surface of the seat 123, around the idler roller 137, and at its other end attached to the roller 129.

The roller 129 includes an internal spring which acts to wind up the conveyor cloth 128 in a similar fashion as in a window shade. The bottom surface of the conveyor cloth 128 and the top surface of the seat 123 preferably comprise slippery materials such as nylon, satin or teflon for low-friction sliding. The track 125*a* is partially supported by the compression spring 130 connected to the frame 121 at one end and to the track 125*a* through the pivot 133. The link 134 connects at one end to the pivot 133 and at the other end to the pivot 135 on the back arm 131.

FIG. 8 shows in dashed lines the positions of the track 125*a* and foot rest 124 and the back arms 131 when a person is seated on the wheelchair, as in FIG. 1*a*. In transferring a person to the bed, the mattress 9 on the bed 2 is raised to the position shown, as illustrated in FIG. 1*b* and described previously, and the back rest (not shown here) is removed from the back arms 131. The latch 132, which locks the wheelchair in its seating position by latching the link 134 to the frame 121, is then manually released, allowing the spring 130 to push the track 125*a* and, through the link 134, to push the back arm 131 against the mattress 9. The mattress 9 is then lowered onto the bed 2, as shown in FIG. 1*d*, thereby lowering the person to a reclining position partly on the wheelchair and partly on the bed and allowing the back arm 131 to lower, and thereby the track 125*a* and leg rest 122 to rise to the transport position. Transport sheet drives (not shown) on bed 2 can then draw the transport sheet 7 off the roller 5 and across the mattress 9, carrying the reclining patient onto the bed 2. The conveyor cloth 128, with the foot rest 124 slides freely with the person over the seat 123 and is wound up by the roller 129. The end position of the foot rest 124 is shown in dashed lines.

Figure 9:
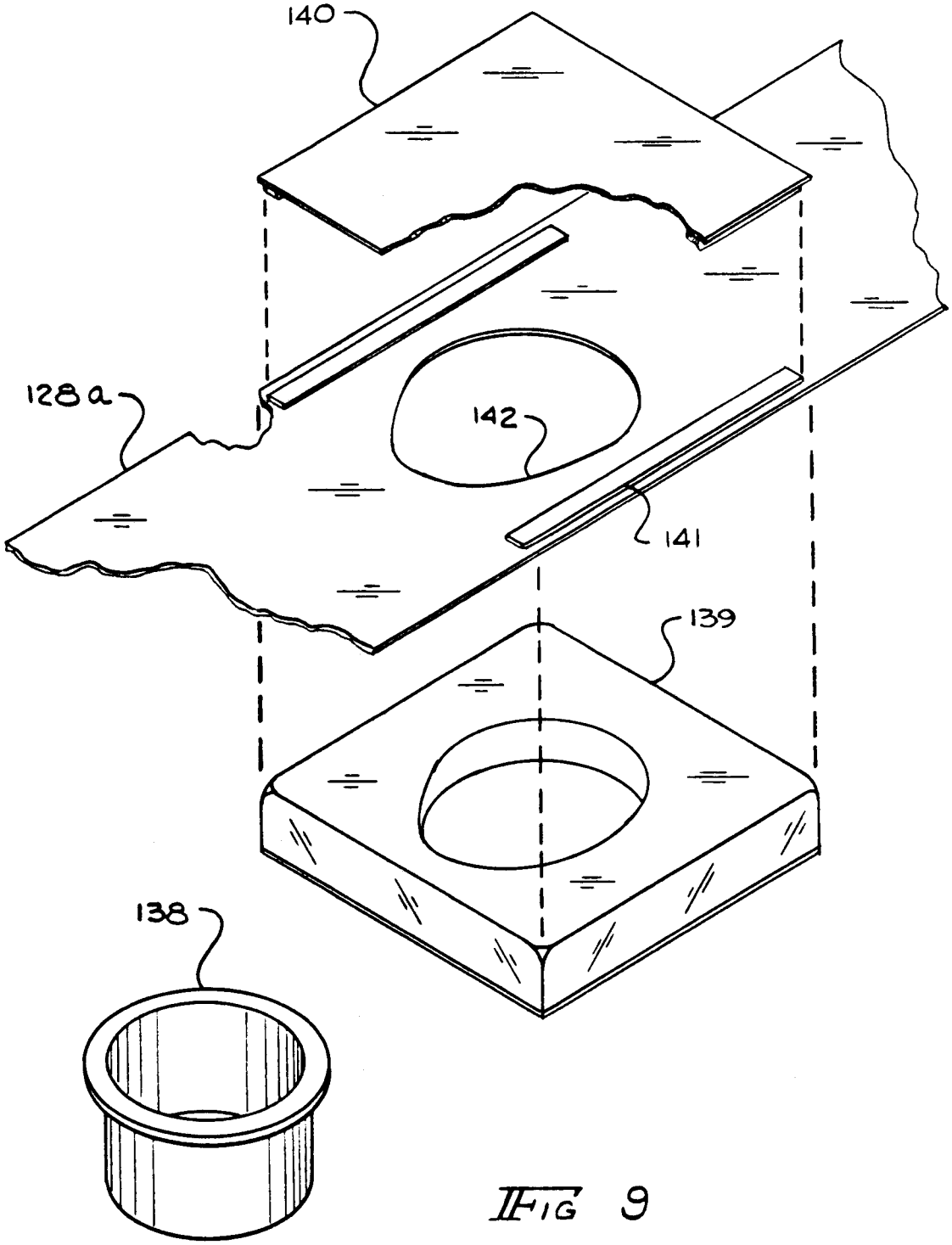
FIG. 9 is a partial perspective view showing a toilet seat, chamber pot and cloth conveyor strip.

FIG. 9 shows a conveyor cloth 128*a* containing a hole 142 for use with a toilet seat 139, which is removably attachable to the frame 121 in FIG. 8, in place of the seat 123. The seat 123 also is usable with conveyor cloth 128*a* when a cloth cover 140 is attached over the hole 142 by strips of touch-and-hold, pull-and-release material such as that available under the trade name VELCRO, or by like means. A chamber pot 138 is attachable to frame 121 below seat 139.

It is to be understood that the arrangements shown in FIGS. 8 and 2 for lifting the leg rest and for transporting the person onto the wheelchair are mutually independent of one another, and that the conveyor arrangement shown in FIG. 8 can be used with the linkage arrangement for raising the leg rest shown in FIG. 2. The conveyor arrangement shown in FIG. 2 can be used with the linkage arrangement for raising the leg rest shown in FIG. 8.

Figure 10:
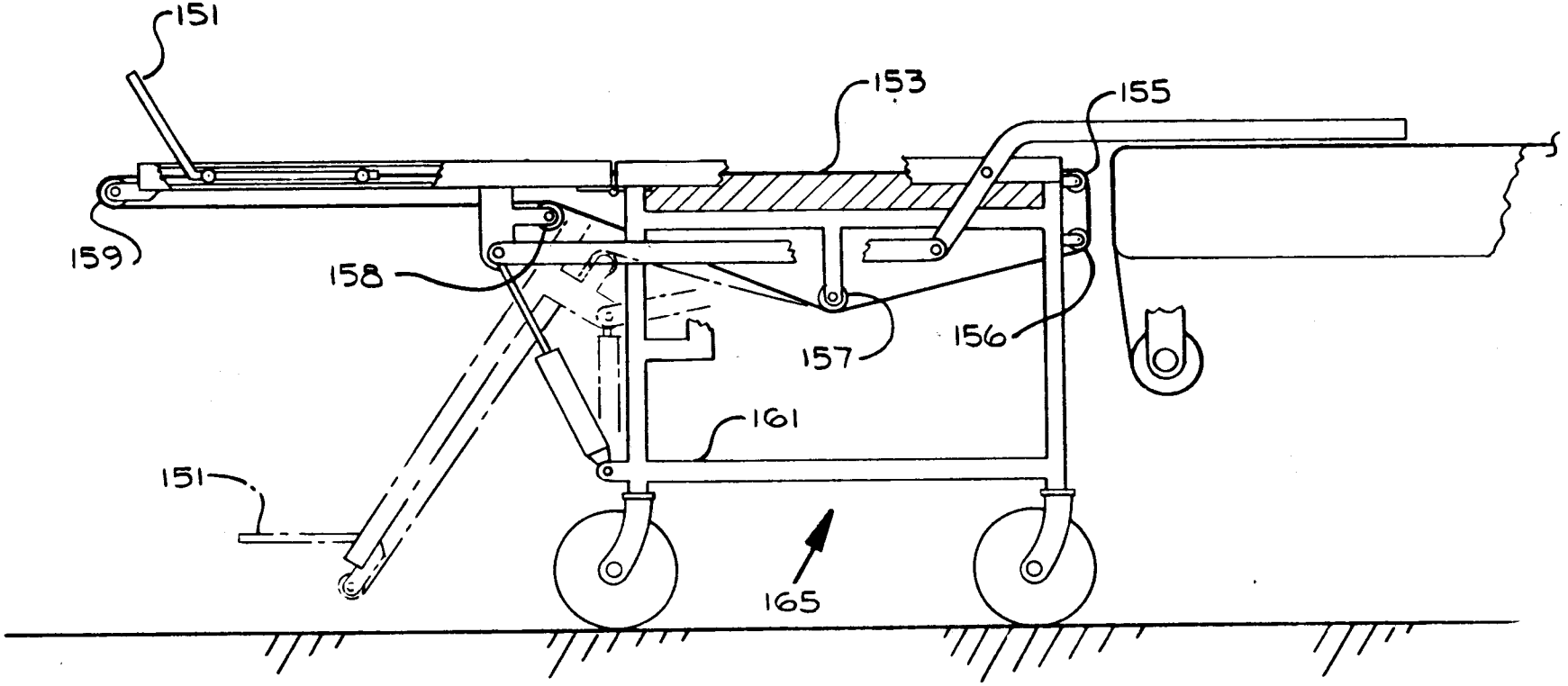
FIG. 10 is a partial side view of the bed and another alternate wheelchair arrangement using a belt around the leg rest and seat.

FIG. 10 is a partial side view of a wheelchair 165, which is the same as the wheelchair 120 in FIG. 8 except for the arrangement of the target conveyor. FIG. 10 shows a conveyor belt 153 which is attached to the movable foot rest 151 and which extends over, around, and under the seat 123 and back to the foot rest. The transport belt 153 is supported by idler rollers 155, 156, 157, and 158, 159 mounted on frame 161 and track 125*a*, respectively. The bottom surface of the transport belt 153 or the top surface of the seat 123 are comprised of slippery material for low-friction sliding, so that a person reclining partly on the conveyor belt and partly on an adjacent bed can be drawn off by a transport sheet on the bed, with the friction of the person's body on the transport belt 153 causing it to move freely. The positions of the rollers 158 and 157 preferably are selected so that the tension of the transport belt 153 increases or remains constant as the front track 125*a* is lowered.

Figure 10A:
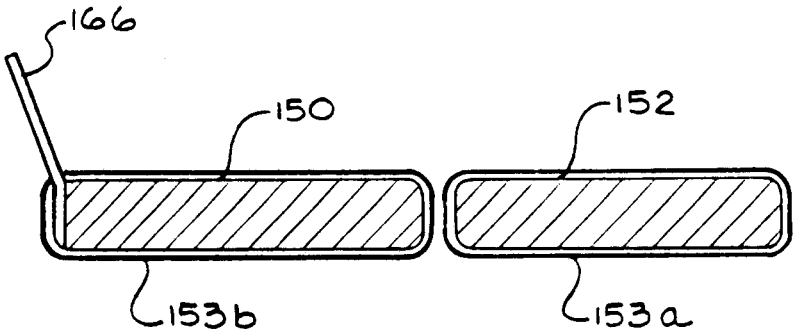
FIG. 10*a* is a side view showing schematically separate belts around the seat and leg rest.

FIG. 10*a* shows schematically another arrangement in which separate transport belts 153*a* and 153*b* pass around a seat 152 and a leg rest 150. The foot rest 166 is attached to the leg rest 150. Preferably, these belts are constructed with slippery material such as nylon or PTFE, commonly available under the trade name TEFLON, on their inside surfaces, and with slippery material used on the outside of the seat 152 and the leg rest 150 so that these transport belts will slide freely as a person is transported onto the seat and leg rest.

Figure 10B:
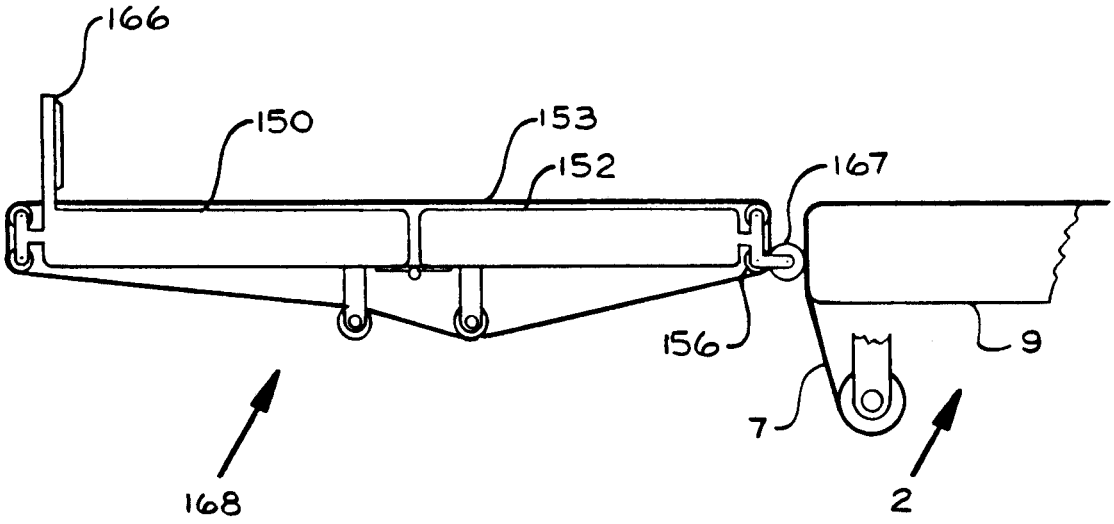
FIG. 10*b* is a partial side view of the arrangement of FIG. 10 with a coupling roller.

FIG. 10*b* is a partial side view of the seat and leg rest of a wheelchair 168 adjacent to the bed 2 showing an arrangement for driving the transport belt on the wheelchair from the transport sheet on the bed. The wheelchair 168 is substantially the same as the wheelchair 165 in FIG. 10 except that the foot rest 166 is attached to the leg rest 150 rather than to the transport belt 153, and an optional roller 167 is attached to the sheet 152 (or, alternatively to bed 2). The roller 167 has a sticky outer surface made of gum rubber or the like and it is held by latching means not shown in firm contact with the transport sheet 7 on the bed 2 and the transport belt 153 on the wheelchair 168. Motion of the sheet 7 causes the roller 167 to rotate, driving the transport belt 153 over the seat 152 in the same direction as the sheet 7 over the mattress 9.

Alternatively, the roller 167, and thereby the transport belt 153 can be driven by an electric motor, in a similar fashion as shown in FIG. 7*a* and described previously.

It is to be understood that the linkage arrangements for raising the leg rest shown in FIGS. 2 and 8, as well as other arrangements for performing this function, can be used with the conveyor arrangements shown in FIGS. 10 and 10*b*.

Figure 11A:
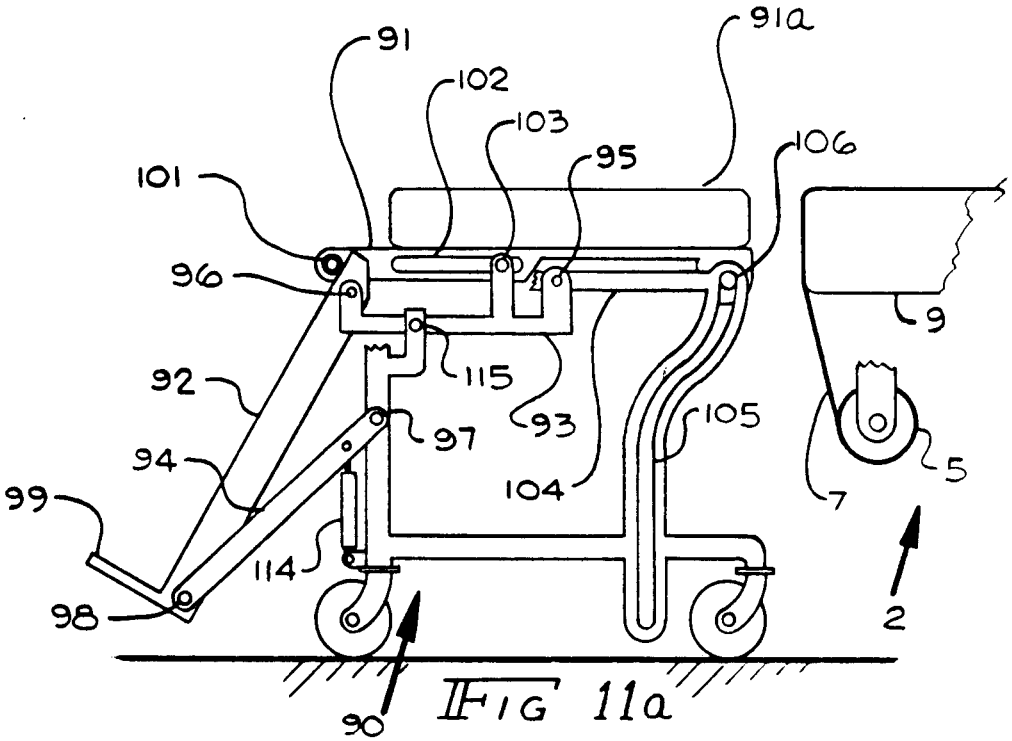
FIGS. 11*a* through 11*c* are partial side views of the bed with another alternate wheelchair arrangement, showing a sequence of operating positions of the wheelchair.
Figure 11B:
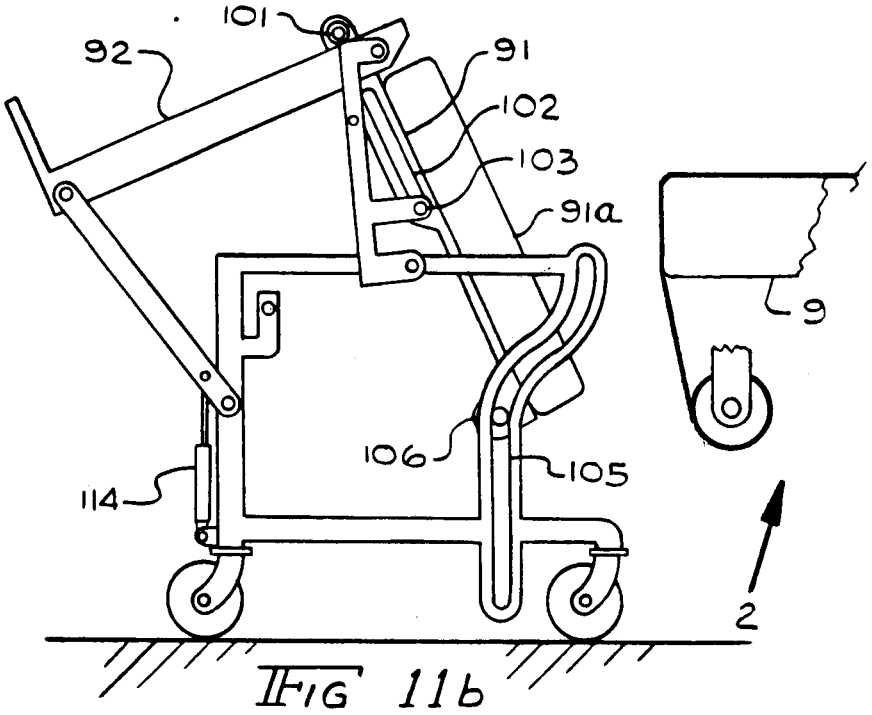
Figure 11C:
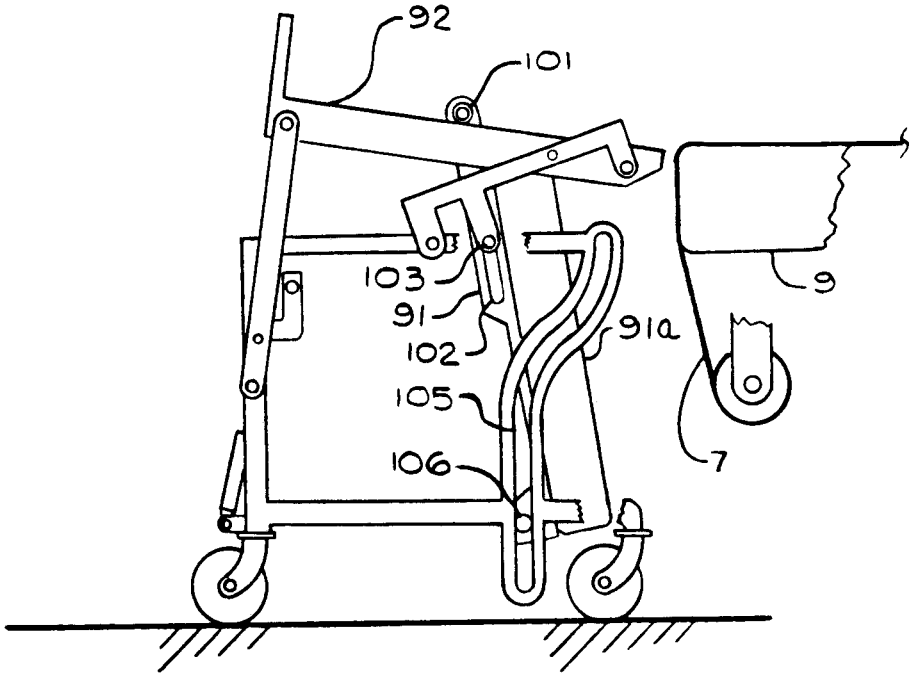

FIGS. 11*a* through 11*c* show schematically in sequence the motion of the leg rest and seat in a still different arrangement for transferring a person from a wheelchair to a bed.

FIG. 11*a* shows a side view of the wheelchair 90 with its back removed and positioned at the foot end of the mattress 9 on the bed 2. A person being transferred from the wheelchair 90 to the bed 2 would be reclining partially on the bed 2 and partially on the seat 91*a* and leg rest 92, with his feet against the foot rest 99.

The leg rest 92 is connected through pivots 98 and 96 to links 94 and 93 which are pivoted on the wheelchair frame 104 at the pivots 97 and 95, to form a 4-bar linkage. The leg rest acting through this linkage is movable from the inclined position shown in FIG. 11*a* to an elevated position shown in FIG. 11c. The seat 91a is mounted on the seat frame 91 which is slidably supported in the slot 102 by the pin 103 of the link 93 and by the roller 101 resting on the leg rest 92. The seat frame 91 includes also the roller 106 which is slidably held in a slot 105 in the frame 104. The seat 91a and leg rest 92 are locked in position by the latch 115 which is mounted on the frame 104 and engages the link 93. To transfer a reclining person fully onto the mattress 9, the latch 115 is released and the transport sheet 7 is drawn off the roller 5 and across the mattress 9.

FIG. 11b shows the motion of the leg rest as a person is moved toward the middle of the mattress 9; the leg rest 92 pivots up and toward the bed 2 with the aid of a compression spring 114. The seat 91a and seat frame 91 are now supported mainly by roller 101 on leg rest 92 as the roller 106 slides down in slot 105. The pin 103, sliding in the slot 102 in conjunction with the roller 106 in the slot 105, holds the seat 91a in the desired position.

FIG. 11c shows the leg rest 92 fully shifted to its transport position adjacent to the mattress 9. From this position continued motion of the transport sheet 7 draws a person's leg off the leg rest 92 and moves him to the center of the mattress 9. The seat 91a, when fully lowered, is supported through its frame 91 by the roller 101 on the leg rest 92, with the seat position controlled by the pin 103 in the slot 102 and the roller 106 in the slot 105.

Figure 12A:
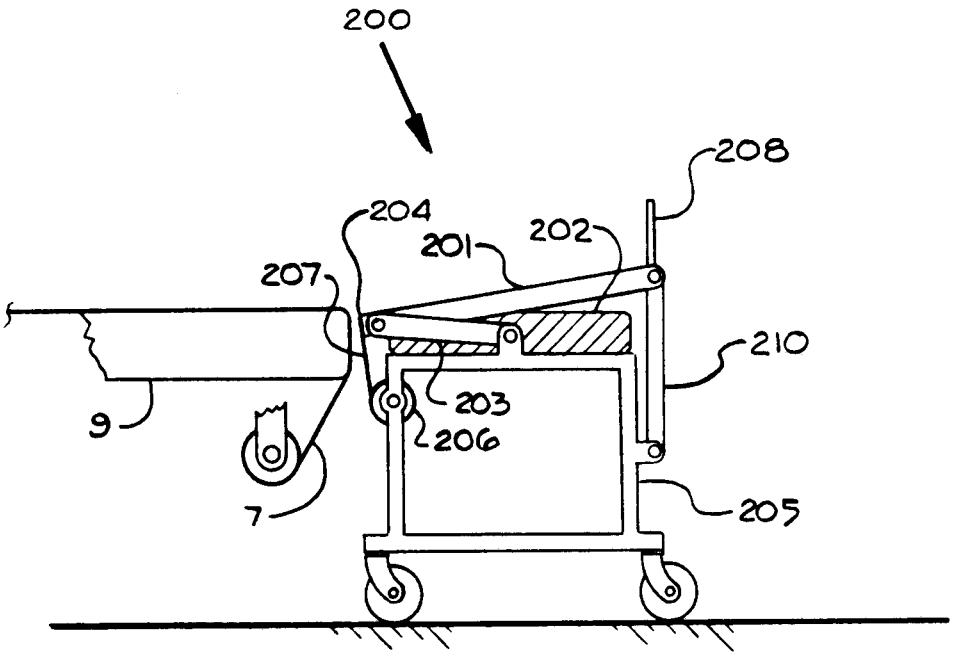
FIGS. 12*a* through 12*d* are partial schematic side views showing another method of moving a cloth strip over the seat of the wheelchair.
Figure 12B:
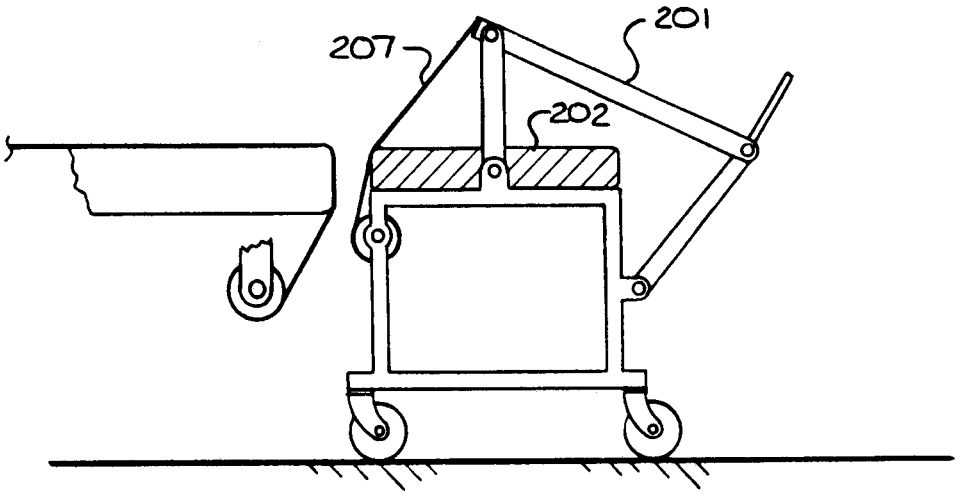
Figure 12C:
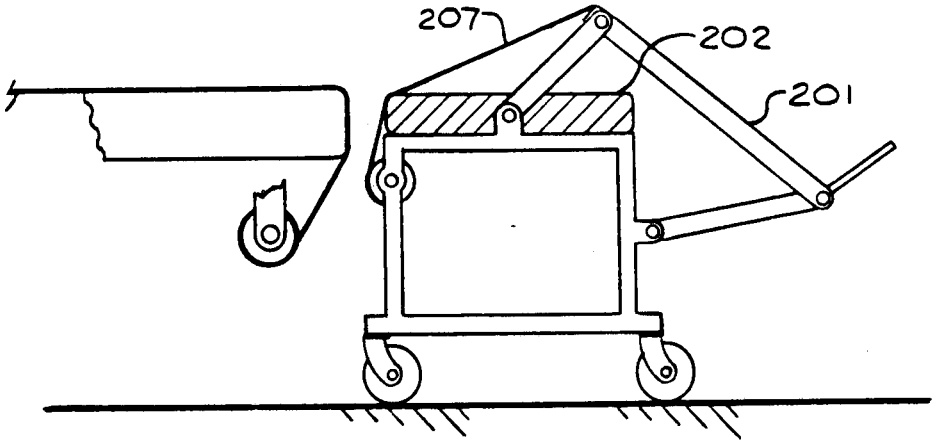
Figure 12D:
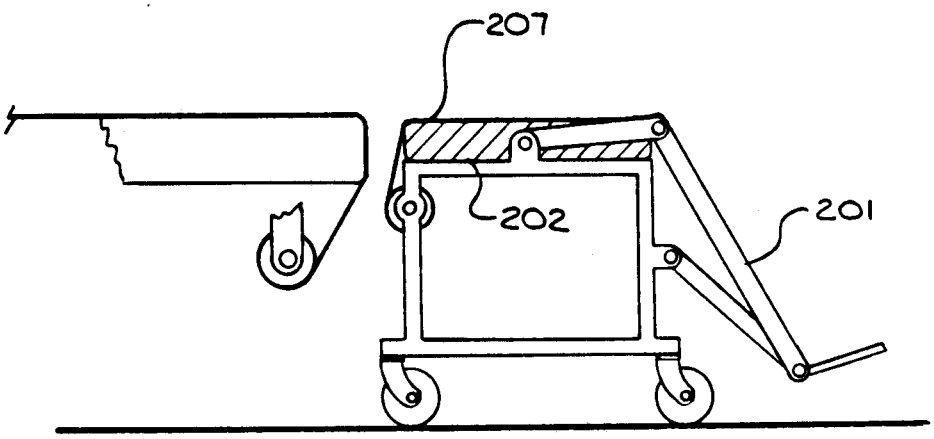

FIGS. 12a through 12d show schematically another method of moving a cloth strip for transporting a person onto a wheelchair. As shown in FIG. 12a, the wheelchair 200 comprises a frame 205 on which is removably mounted the seat 202, which is replaceable by a toilet seat. The leg rest 201 is pivotally connected to the frame 205 by the links 210 and 203 so that the leg rest is free to move from a inclined position above the seat 202 as shown in FIG. 12a for receiving a person being transferred from mattress 9. A strip of cloth 207 is attached at one end to the rear edge 204 of the leg rest 201 and at the other end to roller 206 on which it is wound by a spring. As a person is moved by the transport sheet 7 onto the wheelchair, his feet slide across the leg rest 201 to the foot rest 208. Further motion of a person moves the foot rest, and causes the leg rest 201 to move through the positions shown in FIGS. 12b, 12c and 12d and pull the cloth strip 207 across the seat 202 and thereby insulate the person from rubbing on the seat 202 as he is moved fully onto the wheelchair. It is to be understood that, for purposes of clarity, other items such as compression springs and latches similar to those shown in FIG. 2, which would be used in practice, have been omitted in FIGS. 12a through 12d and 14.

Figure 13:
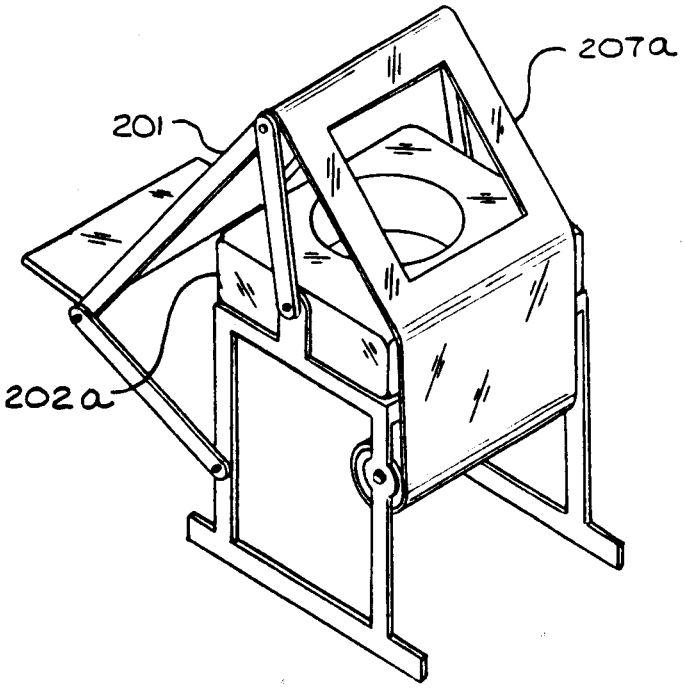
FIG. 13 is a perspective schematic view showing a cut-out section of the cloth strip in FIG. 12*b;*

FIG. 13 shows schematically the cloth strip 207a with a cutout section to provide access to a toilet seat. The leg rest 201 and the cloth strip 207a support a patient during transport over the seat 202a.

Figure 14:
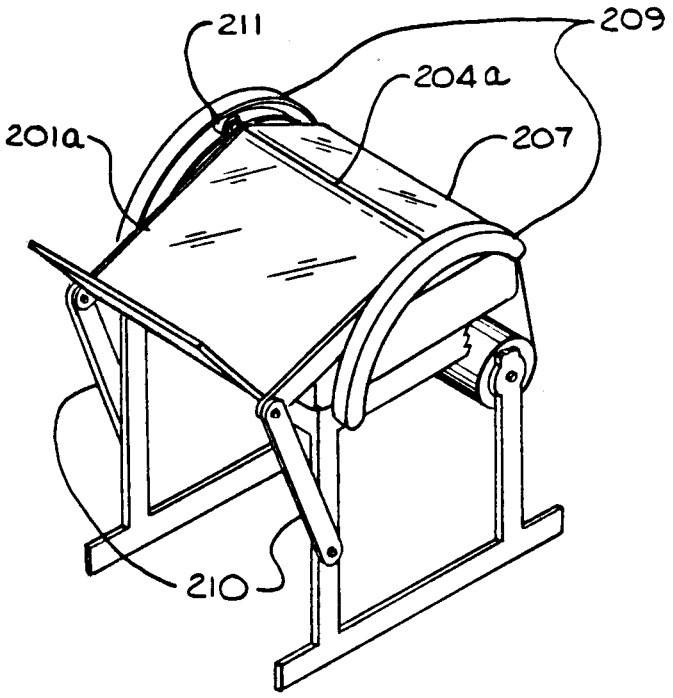
FIG. 14 is a perspective schematic view showing tracks supporting the leg rest on the wheelchair.
Figure 14A:
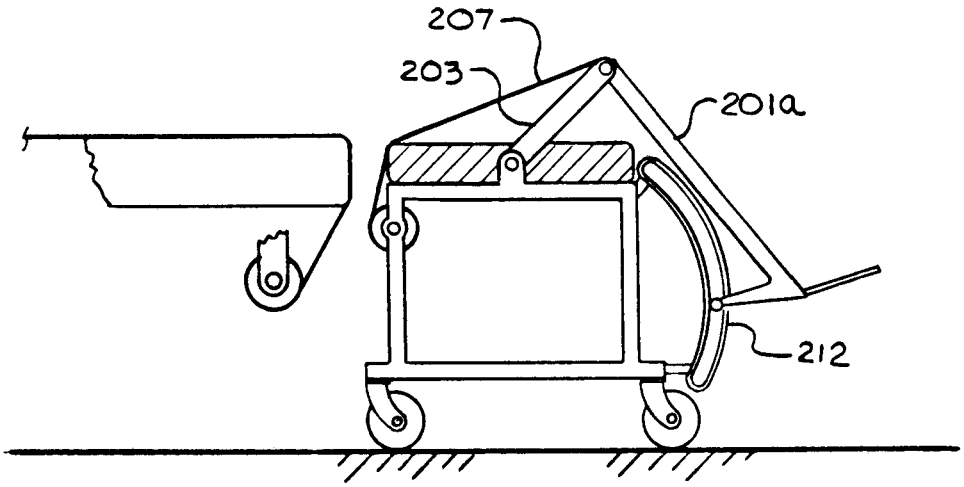
FIGS. 14*a* and 14*b* are schematic side views showing different arrangements of tracks, supporting the leg rest.
Figure 14B:
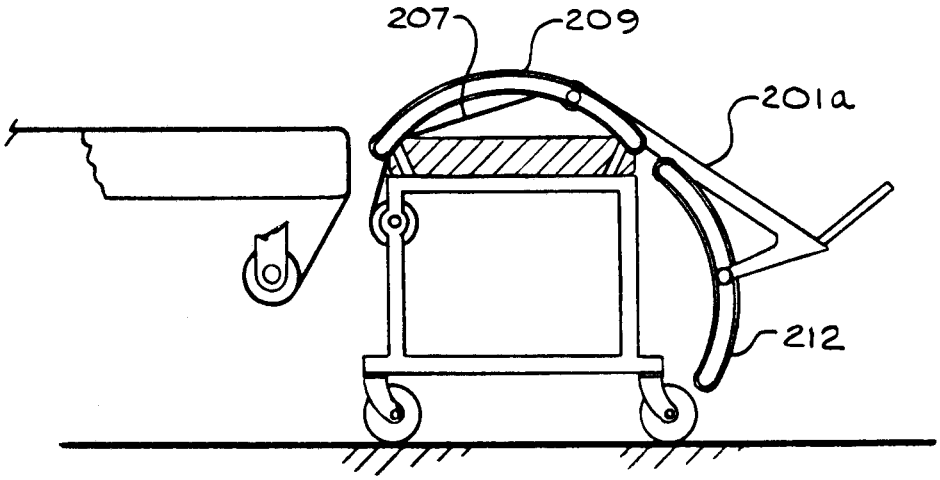

In other embodiments, either one or both sets of links 203 and 210 shown in FIG. 12a are replaced by tracks. FIG. 14 shows upper tracks 209 with the upper edge 204a of the leg rest 201a supported by rollers 211, which move along the tracks. The front of the leg rest 201a is supported by lower links 210. Similarly, FIG. 14a shows lower tracks 212 with upper links 203, and FIG. 14b shows lower and upper tracks 212 and 209 supporting the leg rest 201a. These tracks may comprise circular arcs to duplicate the action of links, or may have other shapes. Preferably a cloth strip 207 is attached to the leg rest 201a as shown in FIGS. 14, 14a and 14b to support a patient from sliding directly on the seat; however, the cloth strip 207 may be omitted, and a slippery seat cover may be used.

Figure 15:
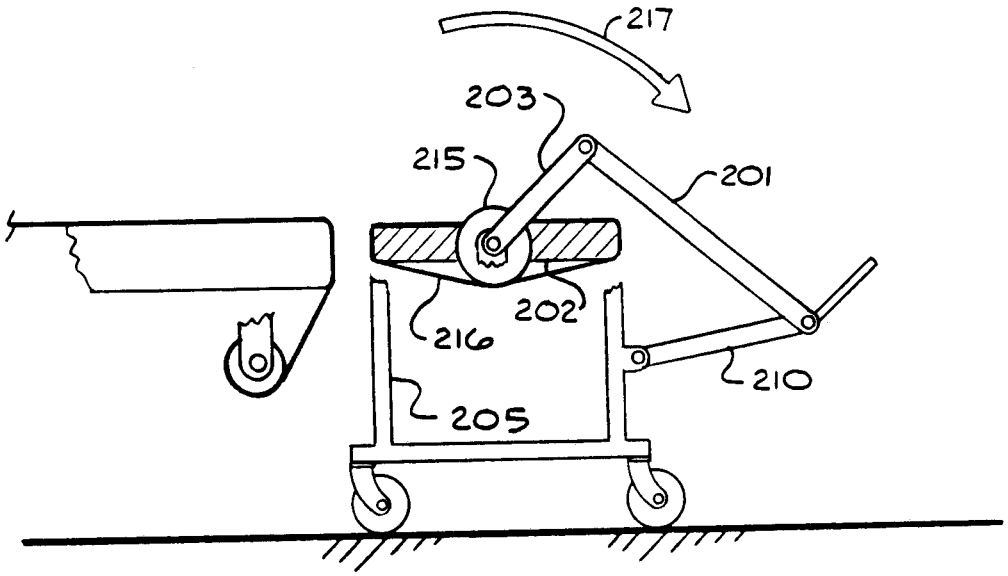
FIG. 15 is a partial side view of a wheelchair showing schematically a conveyor belt coupled through a sprocket wheel to a movable leg rest.

FIG. 15 shows another embodiment using a conveyor belt 216 around the seat 202 of a wheelchair. The leg rest 201 is connected by links 203 and 210 to the frame 205 of the wheelchair. The conveyor belt 216 has holes along an edge which are engaged by sprocket wheel 215 connected to link 203. Movement of leg rest 201 in the direction of arrow 217 causes rotation of link 203 and sprocket wheel 215 which drives the conveyor belt 216 in the same direction, and at substantially the velocity of a person being transferred thereon.

Figure 15A:
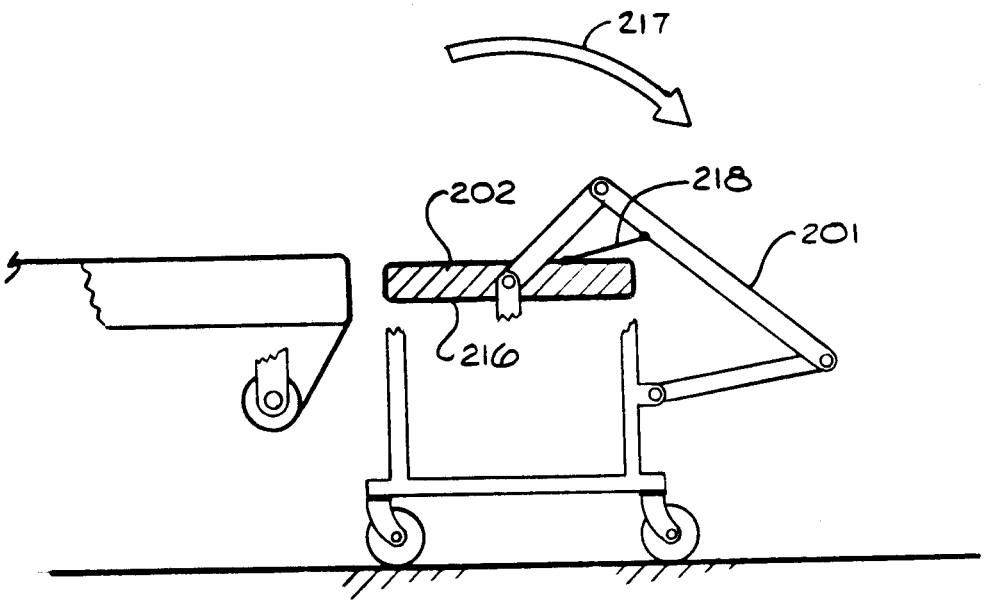
FIG. 15*a* is a similar view showing schematically a conveyor belt connected through a strip of cloth to the leg rest.

FIG. 15a shows another method of coupling between the leg rest and conveyor belt using a strip of cloth 218 attached at one end to the leg rest 201 and at the other end to the conveyor belt 216. When a person is transferred onto the wheelchair in the direction of arrow 217, the leg rest 201 pulls the belt 216 in the direction of arrow 217. The cloth length and attachment points can be selected to make the belt velocity substantially equal to the person velocity.

It is to be understood that there is no intention to limit the coupling means between the leg rest and conveyor belt to the arrangements shown in FIGS. 15 and 15a or to limit the seat rest support arrangement to linkages as shown in FIGS. 15 and 15a. For example, tracks may be substituted for one or both of the linkages, as shown in FIGS. 14, 14a and 14b.

I claim:

1. An invalid transfer arrangement comprising: a wheelchair removably positioned at the end of a bed; said wheelchair having wheels, a frame, a back rest and a seat; and a leg rest all movably attached to said frame; said back rest being removable from behind a person's back seated in the wheelchair; said leg rest being raisable from an inclined to a substantially level position; said bed having a mattress adjacent to and approximately the same height as said level position; a transport sheet extending across the mattress; roller means for moving said transport sheet and transporting a reclining person at a velocity across the mattress and onto said leg rest and seat of the wheelchair; motion means for moving at substantially said velocity a top surface on said leg rest and seat to transport the reclining person so that the persons' buttocks are placed over said seat; lift means for raising said reclining person to a sitting position on the seat; and means for inserting said back rest behind the person.

2. A patient transfer arrangement as defined in claim 1, wherein said top surface is slidable through low friction means, said reclining person being movable onto said top surface and over said seat and leg rest by motion of said transport sheet.

3. A patient transfer arrangement as defined in claim 1, wherein said top surface is connected to said transport sheet through coupling means so that a movement of said transport sheet causes a substantially equal movement of said top surface.

4. A patient transfer arrangement as defined in claim 1 wherein said leg rest and seat are bendable and movable by a conveyor on tracks.

5. A patient transfer arrangement as defined in claim 1 wherein said top surface comprises a strip of cloth movable over said leg rest or seat.

6. A patient transfer arrangement as defined in claim 1 wherein said top surface comprises a strip of cloth attached at one end to a movable foot rest and at the other end to a roller on which said strip of cloth can be wound.

7. A patient transfer arrangement as defined in claim 1 wherein said top surface comprises a belt around said seat or leg rest.

8. A patient transfer arrangement as defined in claim 1 wherein said leg rest is movable through linkage means from an inclined position in front of said seat to a substantially horizontal position near said bed, said seat being movable through sliding linkage and track means to a position below said leg rest.

9. A patient transfer arrangement comprising: a wheelchair removably positioned at an end of a bed; said wheelchair having wheels, and a frame; arm rests and a back rest; a leg rest and a seat removably mounted on a conveyor movably supported by rollers on tracks along both sides of said wheelchair; said tracks including rear tracks along sides of said seat and extending in a curve down and under said seat; said tracks including hinged front tracks movable from a sloping to a substantially level position in line with said rear tracks; a latch holding said front tracks in said sloping or a said level position; side front tracks in said sloping position, said leg rest and said seat being positioned to support a seated person; said arm rests and back rest being movable in vertical slides and connected by coupling means to said front tracks so that depressing said arm rests depresses said back rest to below said seat and raises said front tracks and leg rest to a horizontal position; spring means acting to raise said front tracks; said bed having a mattress extending substantially close to said seat; lift means for elevating part of said mattress to support the back of a person seated on the wheelchair when said back rest is lowered and for lowering said person to a reclining position on said bed and said wheelchair; a transport sheet extending across said mattress and between rollers in vicinity of head and foot ends of the bed; said transport sheet being attached and partially rolled up on said rollers; sheet driving means on the bed for rolling said transport sheet onto one of said rollers and off another said rollers and thereby moving said transport sheet across the mattress and transporting the reclining person off said wheelchair and onto said bed; conveyor motion means whereby said seat and said leg rest move in direction of said transport sheet as said person is transported toward said bed; said seat moving down and below said leg rest as said person is transported off said wheelchair; and attachment means for removably attaching said seat to said conveyor.

10. A patient transfer arrangement as defined in claim 9 wherein said conveyor motion means includes low-friction rollers and bendable seat rest and leg rest whereby said seat rest and said leg rest move with said person as said person is moved by said transport sheet on said bed.

11. A patient transfer arrangement as defined in claim 9 wherein said conveyor motion means includes a coupling roller in contact with said transport sheet and coupled to said conveyor.

12. A patient transfer arrangement as defined in claim 9 wherein said conveyor motion means includes electric motor means.

13. A patient transfer arrangement as defined in claim 9 wherein said conveyor comprises slats extending from side to side across said wheelchair; said slats having ends attached to links; said links having ends with holes overlapping holes in adjacent links hingeably connected by shafts through said holes; and rollers on said shafts for rolling in tracks.

14. A patient transfer arrangement as defined in claim 9 wherein said coupling means comprises linkages with sliding pins and rollers.

15. A patient transfer arrangement as defined in claim 9 wherein said coupling means includes a first link pivoted on said frame and having a pin at one end slidable in a slot on and supporting one of said front tracks; a second link pivoted at one end on said frame and having a front and a rear slot; said first link having a pin at another end slidable in said front slot; said back rest having a pin slidably supported in said rear slot; one of said arm rests being supported and coupled by rollers to top and bottom of said second link.

16. A patient transfer arrangement as defined in claim 9 wherein said conveyor contains a hole; a chamber pot removably mounted below said hole; structure around said hole to slidably support said conveyor; said seat being a toilet seat.

17. A patient transfer arrangement as defined in claim 9 wherein said attachment means comprises touch-and-close, pull-and-release material such as that available under the trade name VELCRO.

18. A patient transfer arrangement as defined in claim 9 wherein said conveyor includes connecting links with elongated coupling holes and said seat includes slots to allow compression for bending in traversing said curve.

19. A patient transfer arrangement comprising a wheelchair removably held in position at an end of a bed by a latch; said wheelchair having wheels, a frame, a removable back rest, a leg rest; leg rest transfer means, whereby said leg rest is movable from a sloping position at the front of said wheelchair to a substantially level position adjacent to said bed; a seat; said bed having a mattress extending close to said leg rest in its level position; a transport sheet on which a person may recline extending across the mattress between rollers in the vicinity of head and food ends of the bed; said transport sheet being attached and partially rolled up on said rollers; sheet driving means on the bed for rolling said transport sheet onto one of said rollers and off another said rollers and thereby moving said transport sheet across the mattress and transporting a reclining person across the bed and onto said leg rest and seat of the wheelchair with the person's back remaining on the bed; and lift means for elevating part of said mattress to raise said person to a sitting position on the wheelchair.

20. A patient transfer arrangement as defined in claim 19 wherein said leg rest transfer means comprises upper and lower links on each side of said wheelchair pivotably connected to said leg rest and to said frame; said seat transfer means comprising slidable supports on said leg rest, said upper link, and said frame so that said seat moves down to below said leg rest and said leg rest moves from the front of said wheelchair to near said bed.

* * * * *